US008505897B2

(12) United States Patent
McIntyre

(10) Patent No.: US 8,505,897 B2
(45) Date of Patent: Aug. 13, 2013

(54) Z-FOLD SIGNATURE FINISHING SYSTEM AND PRINTER

(75) Inventor: Dale Frederick McIntyre, Honeoye Falls, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 13/152,302

(22) Filed: Jun. 3, 2011

(65) Prior Publication Data

US 2012/0306140 A1 Dec. 6, 2012

(51) Int. Cl.
*B41L 43/12* (2006.01)

(52) U.S. Cl.
USPC .... 270/37; 270/39.05; 270/39.06; 270/39.07; 270/58.07; 270/58.08

(58) Field of Classification Search
USPC ..... 270/37, 39.01, 39.05, 39.06, 39.07, 270/58.07, 58.08
See application file for complete search history.

(56) References Cited

U.S. PATENT DOCUMENTS

| | | | | |
|---|---|---|---|---|
| 5,905,819 | A | 5/1999 | Daly | |
| 6,350,073 | B1 | 2/2002 | McCue, Jr. et al. | |
| 6,402,132 | B1 * | 6/2002 | Michaelis et al. | 270/1.01 |
| 7,072,070 | B2 | 7/2006 | Masaki | |
| 7,648,172 | B2 | 1/2010 | Steele | |
| 7,762,537 | B2 * | 7/2010 | Kato et al. | 270/37 |
| 7,800,774 | B2 | 9/2010 | Ferlitsch et al. | |
| 2002/0135176 | A1 * | 9/2002 | Domes | 281/21.1 |
| 2006/0292939 | A1 | 12/2006 | Grunder et al. | |
| 2010/0201774 | A1 * | 8/2010 | Motojima | 347/104 |
| 2011/0268485 | A1 | 11/2011 | Tombs et al. | |
| 2011/0269612 | A1 | 11/2011 | Tombs et al. | |
| 2011/0316215 | A1 * | 12/2011 | Matsuno et al. | 270/37 |

OTHER PUBLICATIONS

"Folding Digital Print Projects", Apr. 4, 2011-Date Printed, DigitalPrintingTips.com.
"Binding Processes", Apr. 4, 2011-Date Printed, DigitalPrintingTips.com.
U.S. Appl. No. 12/845,789, filed Jul. 29, 2010, Tyagi.

* cited by examiner

*Primary Examiner* — Leslie A Nicholson, III
(74) *Attorney, Agent, or Firm* — Roland R. Schindler, II; David A. Novais

(57) ABSTRACT

Z-fold signature finishing systems are provided. One z-fold finishing system has a receiver system to receive a signature print; an automatic z-fold system configured to make a z-folded stack of sheets formed from separate portions of a length of a signature print with each sheet being joined to at least one other sheet in the z-folded stack by at least one of the z-folds; a binding system that can bind the z-folded stack proximate to a saddle fold location between the z-folds; a saddle folder having at least two surfaces arranged so that the at least two surfaces and the z-folded stack can move relative to each other to cause the z-folded stack to fold proximate to the saddle fold location to dispose the z-folds along a common face of the saddle folded stack, and, a separation system separating the signature print proximate to at least one of the z-folds.

13 Claims, 22 Drawing Sheets

L
P12
P1
P4
P9
P5
P8
P11
P2
P3
P10
P6
P7
34
34a
34b
36
74
98
55
70
72
78
80
82
stack
Bind/Saddle Fold
Sep.
Prox.
Z-Fold
1

L
P16
P1
P4
P13
P12
P5
P8
P9
74
88
86
34
34a
34b
P1
P2
P3
P4
P5
P6
P7
P8
P9
P10
P11
P12
P13
P14
P16
55
stack
Bind/Saddle Fold
Sep.
Prox.
Z-Fold
72
70
80
82
1

Z-FOLD SIGNATURE FINISHING SYSTEM AND PRINTER

CROSS REFERENCE TO RELATED APPLICATIONS

This application relates to commonly assigned, copending U.S. application Ser. No. 13/152,305, filed Jun. 3, 2011, entitled: "Z-FOLD SIGNATURE FINISHING METHOD"; U.S. application Ser. No. 13/152,301 filed Jun. 3, 2011, entitled: "Z-FOLD SIGNATURE MEDIA" and U.S. application Ser. No. 13/152,304, filed Jun. 3, 2011, entitled: "METHOD FOR MAKING A Z-FOLD SIGNATURE" each of which is hereby incorporated by reference.

FIELD OF THE INVENTION

The present invention generally relates to methods for forming a signature.

BACKGROUND OF THE INVENTION

Traditionally high speed printing has been performed using offset printing systems. In a typical high speed offset printing system a continuous web of paper is supplied from a large reel and the paper is fed through successive print stations. Each print station has an impression cylinder that is outfitted with one or more patterned printing plates and applies one type of ink to the receiver according to the pattern on the printing plates.

More recently, high-speed plateless printing systems have been introduced that form patterns of one or more colorants or other donor materials on a paper without the use of printing plates. In one example, this is done using digitally controlled print heads that direct fine drops of ink across an air gap and onto a paper. In another example, this is done by digitally creating toner images and transferring these toner images onto a paper. High speed plateless printing systems such as the Kodak Prosper Press Solutions including the Prosper 1000 and 5000 printing systems, the Kodak Versamark V-Series Printing Systems including the VL Series of printing systems, the VX5000 printing systems and VT5000 printing systems and Kodak Nexpress 2100, 2500 and 3000 printing systems all sold by Eastman Kodak Company, Rochester, N.Y., USA, have demonstrated the ability to provide high quality prints at commercial rates of production.

Plateless printers such as those described above also offer greater flexibility, adaptability, and efficiency than can be provided by conventional plate based offset printing. For example, plateless printing systems have the ability to provide a greater range of print sizes, print shapes, and print aspect ratios than plate based systems. Further, plateless printing systems can vary what is printed on a page by page basis whereas plate based offset printers print the same content on every printed page that is printed using a printing plate. The printed output of both offset and plateless printing systems is typically processed to form into finished articles, such as newspapers, pamphlets and books using conventional equipment. However, much of the commercially available finishing equipment equipment is adapted for use with conventional offset presses. Accordingly, the printed output of plateless printing systems is typically made to conform to the characteristics of the printed output of offset printers to enable such printed output to be processed using such finishing equipment. Thus, many opportunities for unique and improved output options made possible through plateless printing are sacrificed to enable compatibility.

For example, one of the more desirable printed products is a bound combination of printed pages such as are used in making a book or booklet. A conventional process for forming such a book or booklet is by offset printing a large sheet within the printed large sheet that is about the same size as a printing plate with printed pages that are arranged within the printed so that the large sheet can be folded to form smaller sheets with the printed pages in a desired order. The folded sheets are bound together and the folds are trimmed as necessary to allow pages to be turned. The folded, bound, and trimmed output generated from a single printed sheet is conventionally known as a signature. A signature can be used for many purposes. For example, a single signature can form a small booklet or pamphlet with a limited number of pages or a signature can be bound together with other signatures to provide a thicker publication such as a book. A wide variety of other foldable output products are known and various examples of folding processes that can be used for folding a multi-page printed sheet into a signature into a signature or other multi-page printed output, are illustrated in a worldwide web page entitled: "Folding Digital Print Projects", published by Tecstra Systems, at http://digitalprintingtips.com/printing-tips-t-30-540/folding-digital-pintprojects.asp.

FIGS. 1 and 2A-2C illustrate a widely used method for using a printed paper generated by a continuous web printing system 200 to prepare a signature 240. Referring now to FIG. 1, printing system 200 prints on a paper 202 that takes the form of a web 204 that is substantially continuous along a length of paper 202 and that is stored as a roll 206 wound on a core 208. During printing, paper 202 is fed lengthwise into system 200 from roll 206 and advanced along a transport path T through one or more printing subsystems shown here as printing subsystems 212*a*, 212*b*, 212*c*, and 212*d* such that a printed paper 214 is formed having printed areas 210 on both a first side 214*a* and a second side 214*b*.

As is also shown in FIG. 1, printing system 200 includes a finishing subsystem 216 with a cutter (not shown) of conventional design that separates a printed paper 214 from web 204 of paper 202 and a series of folders 218*a*, 218*b*, and 218*c* creates a series of folds in printed paper 214. In this example, first folder 218*a* forms a first fold F1 in printed paper 214 along the length of printed paper 214, second folder 218*b* forms a second fold F2 is across a width of the first folded paper 214 and third folder 218*c* forms third fold F3 across a width of the first folded and second folded paper 214. The printed and folded paper 214 is then bound proximate to third fold F3 and trimmed to form a form signature 214 with pages that can be turned about the binding at the third fold F3.

FIGS. 2A-2C illustrate various aspects of the conventional signature making process of FIG. 1 in greater detail. FIG. 2A provides an example of a paper 214 printed on first side 214*a* and on second side 214*b*. In this example, page prints 1-16 represent portions of printed paper 214 that are assigned to receive any printing that is to be presented on pages 1-16 of the signature 240 after folding. Accordingly, page prints 1-16 are arranged as required to enable a 16 page signature to be made by folding printed paper 214 according to the prior art method for making a signature. In FIG. 2A, respective locations and orientations for each of the 16 page prints are shown as boxes numbered 1-16.

FIG. 2B illustrates use of the conventional method to convert a printed paper 214 of FIG. 2A into a signature 240 having pages 1-16 arranged in a sequential fashion. At the first fold F1, printed paper 214 is folded across a length to yield two equal sized sheets 220 and 222 jointed at first fold F1. At the second fold F2, sheets 220 and 222 are folded together across a width of sheets 220 and 222 to yield four equal sized folded sheets 225, 227, 229 and 231 joined at first fold F1 with sheets 225 and 227 also joined at second fold F2 in sheet 220 and with sheets 229 and 231 joined at second fold F2 in sheet 222. During a third fold F3, sheets 225, 227, 229 and 231 are then folded across a width and to yield eight two sided sheets shown here as sheets 233, 235, 237, 239, 241, 243, 245, 247, and 249 with printed pages 1-16 sequentially arranged on respective front and back sides thereof. All of these sheets are joined at first fold F1 with sheets 243 and 245 joined at second fold F2 and with sheets 247 and 249 joined at second fold F2.

As is also shown in FIG. 2B, in the method of FIGS. 1 and 2A-2C, folds F2 and F3 involve nested folding of two or more adjacent, parallel and equally sized sheets. As is shown in FIG. 2C, when two adjacent and equally sized sheets 220 and 222 are folded across a width at fold F2, the folded sheet that is closest to fold location F2, shown here as sheet 220, has a first fold radius 232 and fold F2 and a first fold length 234 defined by a length of sheet 220 that is used in allowing sheet 220 to fold. In comparison, a second folded sheet that is further from second fold F2, shown here as sheet 222, will be folded about first sheet 220 in order to make second fold F2 and will necessarily have a second fold radius 242 that is greater than first fold radius 232 and therefore will also have a second fold length 244 that is longer than a first fold length 234. Thus, where, as here, first sheet 220 and second sheet 222 have the same length, the shorter first fold length 234 of first sheet 220 will cause folded sheets 225 and 227 to extend from second fold F2 to a greater extent than sheets 229 and 231 will extend from second fold F2. Therefore, an uneven edge is formed opposite second fold F2 and the lateral location of printed pages can be in different places and can appear to shift relative to second fold F2 from page to page. These outcomes can be seen as objectionable in many printed products.

The page extension variations caused by such multi-page folding are commonly known as creep. The extent of creep in a signature 240 can vary depending on characteristics such as paper thickness, printing type, page stiffness, humidity, temperature, and other factors.

It will also be appreciated that creep related page extension variations of the type shown in FIG. 2C also arise at a face of signature 240 that is opposite to third fold F3. However, the extent of such creep induced variations at the face of signature 240 that is opposite from third fold F3 is typically more pronounced than the extent that exists at second fold F2. In one respect, this is because four equal sized sheets are folded about third fold F3 thus the difference between the fold length of an outermost folded sheet at third fold F3 and the fold length of an inner most folded sheet at third fold, F3 is greater than the difference between fold lengths 234 and 244 of sheets 220 and 222 folded at second fold F2.

In another respect, this can be because the fold at F3 is a fold of sheets that may exhibit creep formed at the second fold F2, thus the extent of the variations in the extent to which pages created at third fold F3 extend from third fold F3 reflect not only those induced at third fold F3, but also those induced at second fold F2, compounding the extent of creep related variations at the face opposite third fold F3.

The conventional method for forming a signature provides a signature 240 that has a number of limitations. As is illustrated in FIG. 2B, the first limitation is that all pages in signature 240 are joined by first fold F1 and two more page pairs are joined at second fold F2. These pages must be separated to provide eight independently turnable pages. Further, a folded signature 240 of the prior art has a first face 236 along which all pages of signature 240 are joined to at least one other page by the first fold F1 and a second face 238 opposite from the third fold F3 along which certain pages are joined by second folds F2.

One way to address these problems is to trim signature 240 along first face 236 to remove first folds F1 from signature 240 and to trim signature 240 along second face 238 to remove second folds F2 from signature 240. Such trimming can also be used to form an edge opposite third fold F3 with pages that extend from fold F3 by a common distance. However, it will be appreciated that first face 236 and second face 238 are arranged along orthogonal edges of signature 240. Thus a single axis trimming tool cannot be used for this purpose without rotating either the signature 240 or the trimming tool.

Alternatively, two trimming tools can be used with one trimming tool arranged to trim signature 240 along first face 236 and another arranged to trim signature 240 along second face 238. However, this approach is more expensive and in certain circumstances may require cutting across a direction of movement of signature 240 which can interrupt finishing work flow.

Further, conventional signature forming methods make signatures using half sheet folding processes. Thus, the number of pages that can be in a signature that is made in this fashion is a fraction of the number of folds, such that the number of pages $P=2^N$ where N is the number of half sheet folds and a conventionally made signature typically provides 4, 8, 16, or 32 pages. Thus, to prepare a finished output that does not require one of these numbers of pages, some modification of the conventional sequence is required, for example, to prepare a 24 page product, a 32-page signature can be formed, however this includes eight unnecessary pages. These unnecessary pages can be removed from the signature however; this wastes paper and adds time and labor expense.

Another limitation of conventional signature making methods is that they severely restrict page sizes and aspect ratios by relying on half sheet folding processes. For example, the folding limitations and tolerances required by trimming and other operations, can make it difficult to print and finish small books, such as novelty books, flip books, marketing materials, photo albums, and photo books consumer photographs at small or standard sizes, such as 4×6 inches, for example.

It will be appreciated from the above that conventional methods and apparatuses for signature preparation do not take advantage of new capabilities provided by plateless printing systems. This includes the capability to print jobs of various page lengths, and various pages sizes, and to switch from one job to the next without interruption of the high speed plateless printing process.

Thus, it can be seen that in order to meet the needs of a dynamic printing market, there is a need for printing systems and finishing systems and methods that enable the formation of signatures in a manner that efficiently produces signatures while also leveraging the increased flexibility and advanced capabilities of plateless printing systems.

SUMMARY OF THE INVENTION

Z-fold signature finishing systems are provided. In one embodiment, a z-fold finishing system has a receiver system to receive a signature print; an automatic z-fold system configured to make a z-folded stack of sheets formed from separate portions of a length of a signature print with each sheet being joined to at least one other sheet in the z-folded stack by at least one of the z-folds; a binding system having a binder that can bind the z-folded stack across a width of the stack proximate to a saddle fold location between the z-folds; a saddle folder having at least two surfaces arranged so that the at least two surfaces and the z-folded stack can move relative to each other to cause the z-folded stack to fold proximate to the saddle fold location to dispose the z-folds along a common face of the saddle folded stack, and, a separation system separating the signature print proximate to at least one of the z-folds.

DETAILED DESCRIPTION OF THE INVENTION

Figure 1:
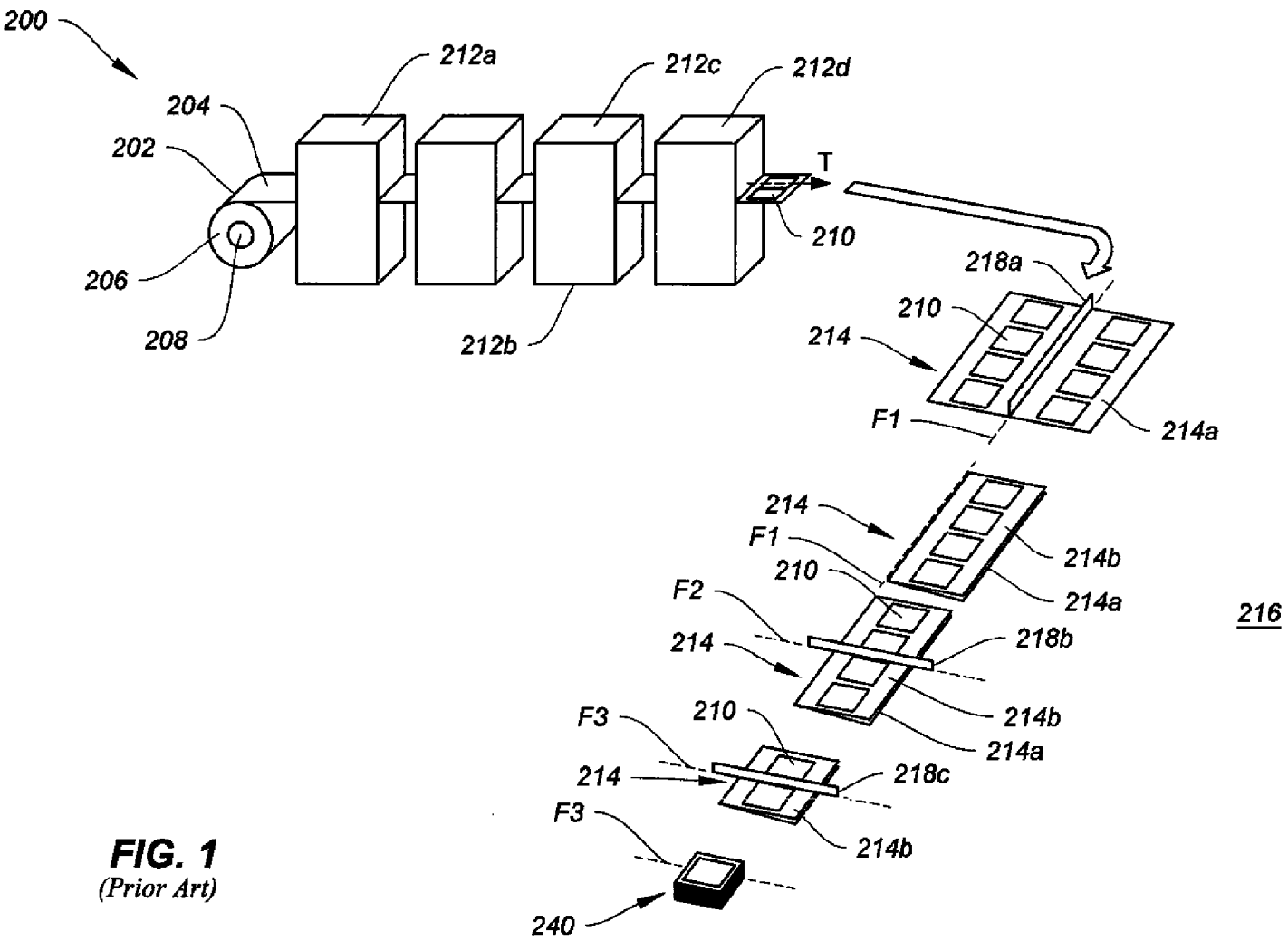
FIG. 1 (Prior Art)
FIG. 1 is a block diagram showing how a saddle-stitched signature is conventionally formed from a web printing system.

In the drawings and text that follow, like components are designated with like reference numerals, and similar descriptions concerning components and arrangement or interaction of components already described are omitted. Where they are used, the terms "first", "second", and so on, do not denote any ordinal or priority relation, but are used to more clearly distinguish one element from another. Drawings are provided in order to illustrate and emphasize important concepts and are not necessarily drawn to scale.

In the context of the present disclosure, the term "signature" is used as a general term to describe a multi-page printed and finished article or portion of a document that is formed by folding a single sheet of a signature print or suitable substrate useable in making a signature print 34. A book, booklet, magazine, or other multipage finished article can be formed as a single signature 80, or a combination of signatures 80 that are bound together in a proper sequence with activating materials accompanying edge binding or stitching as desired.

Figure 3:
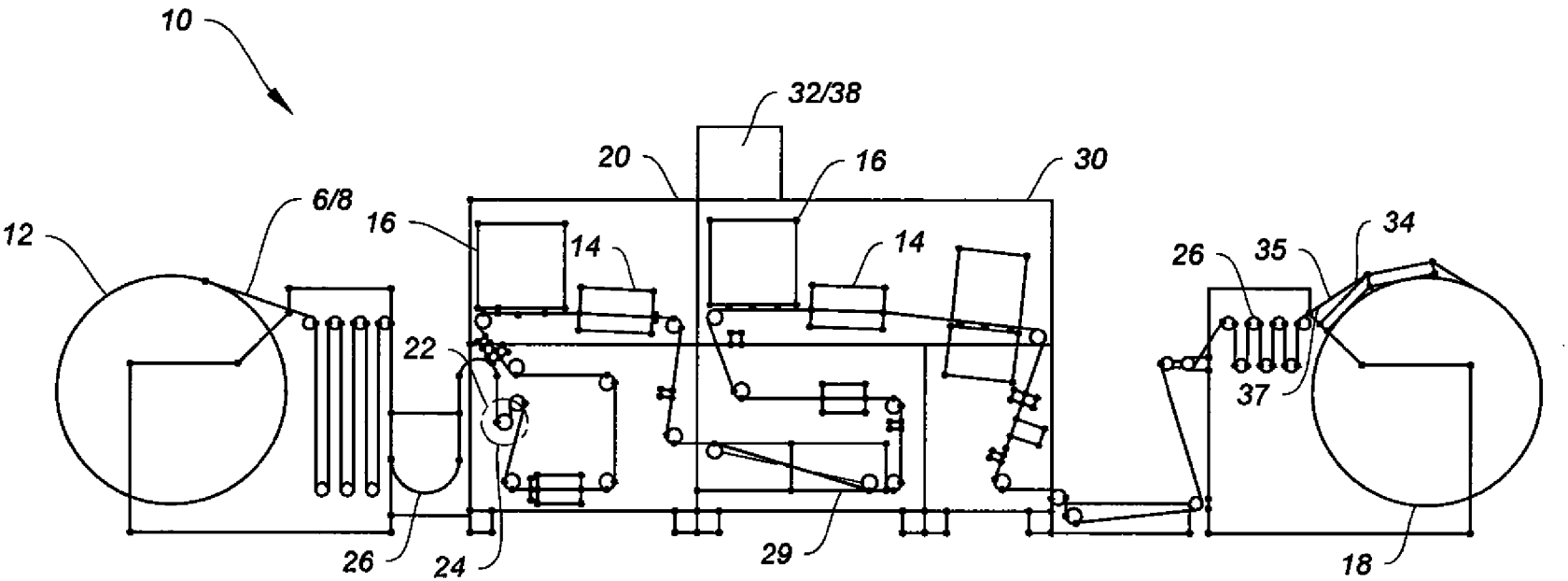
FIG. 3 is a schematic side view diagram that shows a continuous web printing system using plateless printing.

Referring to FIG. 3, what is shown is one embodiment of a printing system 10. In the embodiment of FIG. 3 printing system 10 has a first printing module 20 and a second printing module 30 that print on a receiver medium 8 that is supplied in the form of a web 6 from, in this embodiment, a source roll 12. Following an initial slack loop 26, web 6 receiver medium 8 is directed through printing system 10, past one or more print engines 16 that cause patterns to form on receiver medium 8 and any supporting components such as an optional dryer 14. First printing module 20 has a support structure that typically includes web guidance features such as an edge guide or other positioning mechanism 22 for positioning web 6 of print receiver medium 8 and a tensioning mechanism 24 that sets a tension of the web 6 of receiver medium 8. Receiver medium 8 can comprise, generally, any type of material on which a pattern can be printed and that can be processed in accordance with the methods described herein or the z-fold signature finishing system 40 described herein. Receiver medium 8 can include but is not limited to films, fabrics, papers, synthetic films, metals, woven materials, polymer substrates. Receiver medium 8 can take the form of a web 6, a sheet or other surface that can be used to make a signature using the methods, signature prints, or apparatuses described herein.

Downstream from first printing module 20 along the path of movement of web 6 of receiver medium 8, second printing module 30 also includes a turnover mechanism 29 that is configured to turn web 6 receiver medium 8 over, flipping web 6 backside-up in order to allow printing on a reverse side by second printing module 30.

In the embodiment of FIG. 3, printing system 10 has a printing system controller 32 which controls the operation of printing system 10 and can comprise any form of logic controller or logic control system including but not limited to a microprocessor, computer, controller, programmable logic controller, or programmable analog logic control system and can include sensors and actuators (not shown) that are positioned to sense conditions in printing system 10 to cause movement and processing web 6 of receiver medium 8. Printing system controller 32 can include a printer communication system 38 that can enable wired or wireless communication with other devices such as z-fold signature finishing system 40 as well as any system, communication network, memory or other device or combination of devices that can provide printing instructions as described herein.

The modularity of a printing system, such as printing system 10 of FIG. 3, enables two or more printing modules 20 and 30 to be connected together in order to provide particular printing capabilities. Module 20 is a four-color printer in one embodiment, applying precisely registered ink dots of cyan, magenta, yellow, and black (CMYK) in sequence onto the moving web 6 of receiver medium 8, then drying the first printed medium at dryer 14. First printing module 20 then passes the first printed web 6 of receiver medium 8 to turnover mechanism 29 that flips receiver medium 8 over and performs CMYK printing onto the opposite side of the medium.

In the embodiment of FIG. 3, printing is performed in accordance with printing instructions received at printer controller 32. Such printing instructions can be generated at printing system 10 using for example such printing instructions can be provided to printing system 10 from a remote device and received using a printer communication system 38. Alternatively, any known form of user interface device (not shown) can be provided at printer. Printing instructions will typically include sufficient information to enable printing system controller 32 to determine how and what first printing module 20 and second printing module 30 are to print on web 6 of receiver medium 8 to form a signature print 34. Such printing instructions can include information such as image data that defines the text images and other content to be printed on web 6 of receiver medium 8, print size data, print aspect ratio data, receiver medium type information, information regarding the signature made such as a page width, a page length, an aspect ratio, a number of pages of a signature, and any other information that can be useful to printing system controller 32 in determining what to print on web 6 of receiver medium 8 in a manner that can be converted into a signature as described herein.

Figure 4:
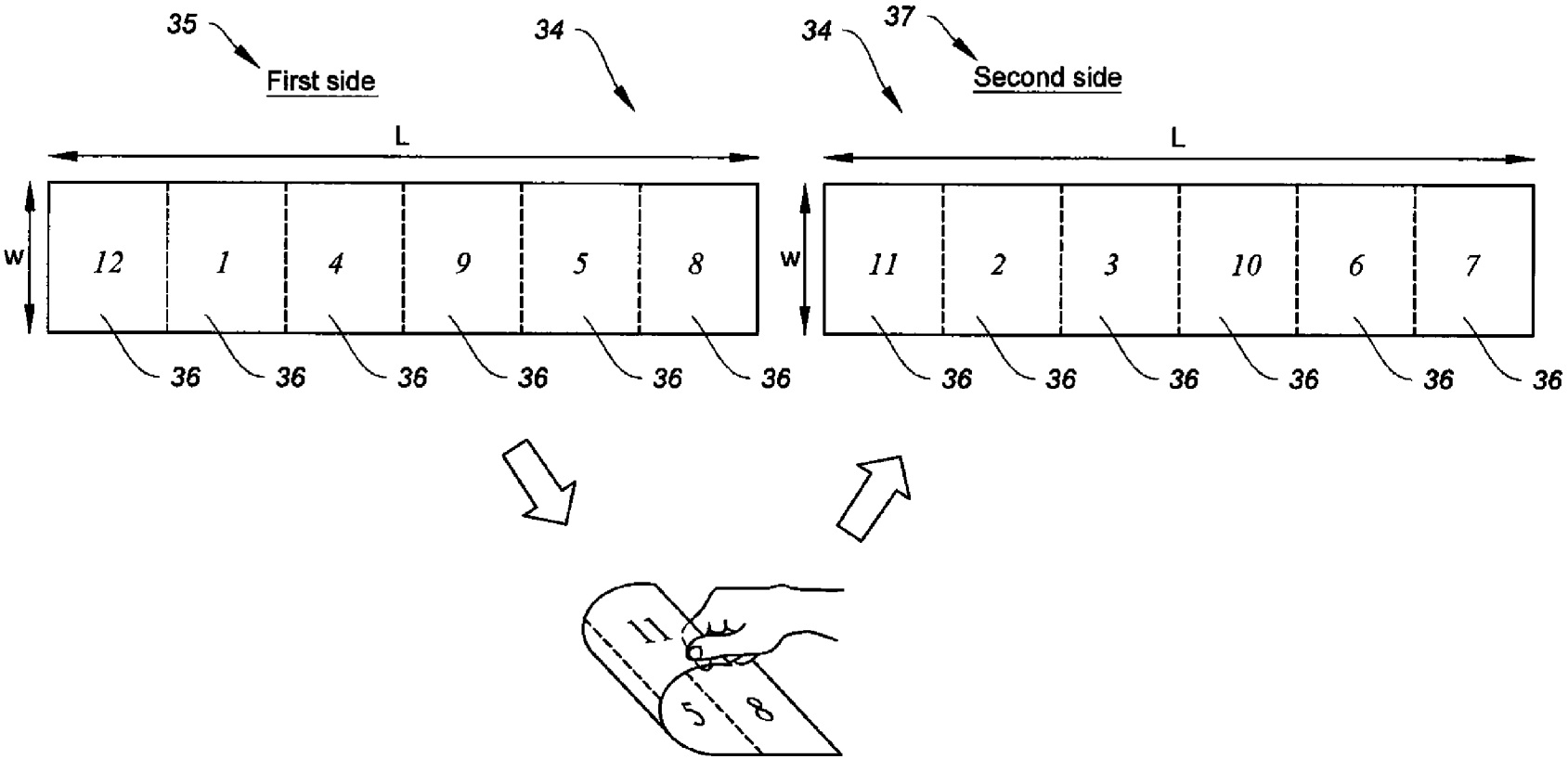
FIG. 4 shows a first embodiment of a signature print.

In particular, FIG. 4 illustrates one embodiment of a signature print 34. As is shown in FIG. 4, signature print 34 has twelve pages areas 1 to 12, with six page areas 36 arranged on first side 35 of signature print 34 and six page areas 36 arranged on second side 37 of signature print 34. Page areas 36 are arranged along a length L of signature print 34 in a manner that will cause the page areas 36 to appear in sequence when signature print 34 is finished as described in the various embodiments herein. Reference numbers 1-12 in FIG. 4 indicate the order in which page areas 36 will appear in such a signature print 34.

As is shown in the embodiment of FIG. 4, page areas 1-10 have a common orientation relative to a length L and a width W of signature print 34. However, while such a common orientation is highly useful, it is not required.

In other embodiments, printing system 10 can perform additional operations, including application of fewer or additional colors, application of laminates or other fluids or coatings, use of slitters or perforating devices, and can optionally print or apply materials or energy to web 6 in preparation for finishing operations. In still other embodiments, z-fold signature finishing system 40 can be provided as a component of a printing system 10 or as a modular attachment thereto and in such case printing system 10 can comprise a supply of signature print 34 as described below. Instructions or information causing printing system 10 to perform such additional operations can be included in the printing instructions.

Printing system 10 is adapted to print on web 6 of receiver medium 8 to create a signature print 34 having page areas 36 that are arranged along a length of the signature print 34 on a first side 35 and on a second side 37 of signature print 34.

In the embodiment of printing system 10 illustrated in FIG. 3 signature print 34 is shown being wound onto a take-up roll 18. One or more take up slack loops 28 can also be provided after printing using printing system 10 to facilitate drying and to minimize binding. Take-up roll 18 can then be moved to z-fold signature finishing system 40. Alternately, take-up roll 18 is not used and a z-fold signature finishing system 40 can directly receive a signature print 34 from printing system 10. Printing system 10 can include a number of other components, including multiple print heads and dryers, for example, as described in more detail subsequently. In general, any plateless type of printing system 10 can be used for printing the signature print 34 including cut sheet type printers.

Figure 5:
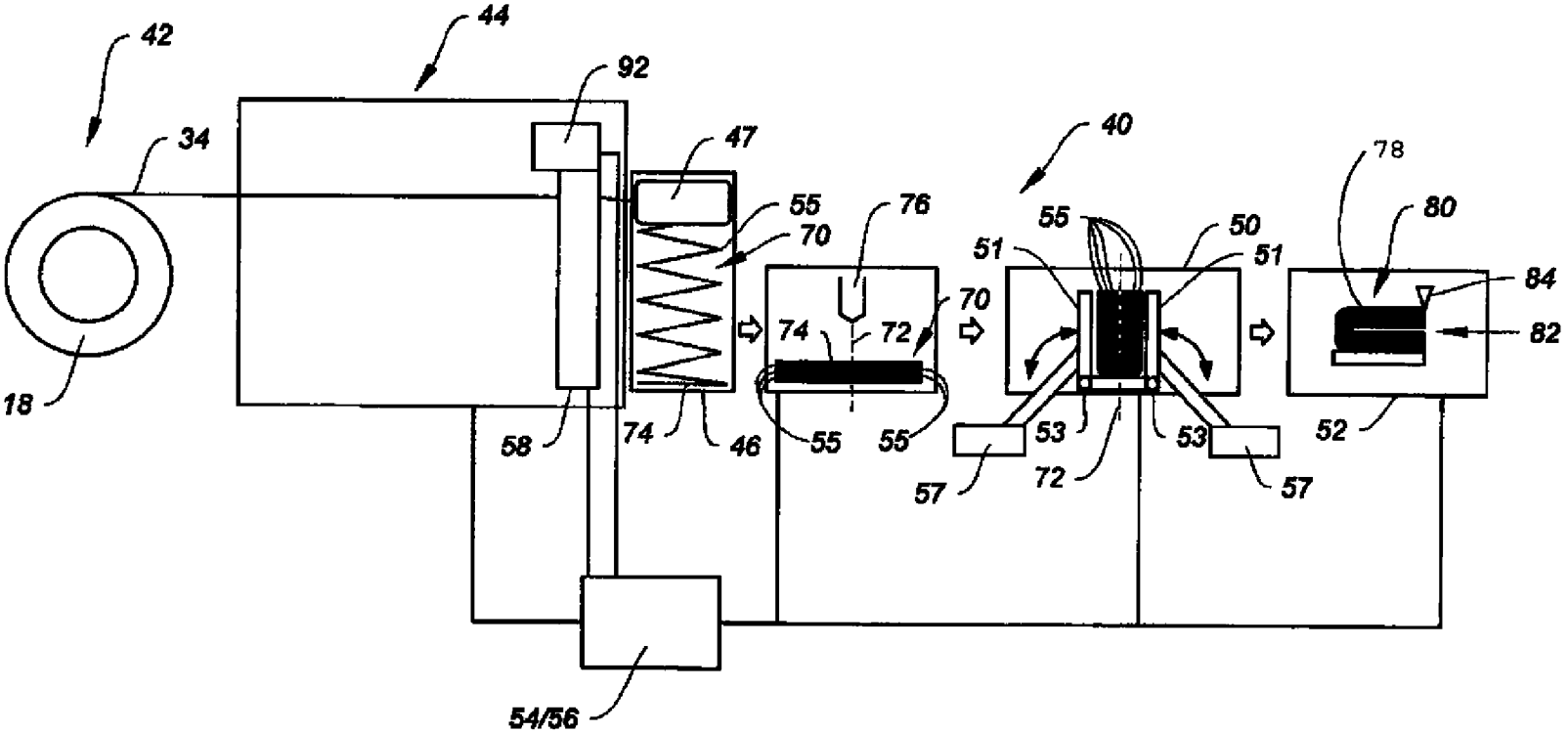
FIG. 5 shows a first embodiment of a z-fold finishing system.

The block diagram of FIG. 5 shows a first embodiment of a z-fold signature finishing system 40. In this embodiment z-fold signature finishing system 40 includes an optional supply 42 that provides one or more signature printers 34. In this embodiment supply 42 receives take-up roll 18 and supplies signature print 34 to a receiver system 44. Receiver system 44 receives signature print 34, an automatic z-fold system 46 in which signature print 34 folds to provide a z-folded stack 70 of sheets 74 of signature print 34, a binding system 48 that binds z-folded stack 70 proximate a saddle fold location 72 and a saddle fold system 50 that saddle folds the z-folded stack 70 proximate the saddle fold location 72, a separation system 52 that separates at least one of the z-folds 55 and a finishing system controller 54. Finishing system controller 54 controls the operation of other systems of z-fold signature finishing system 40 and can comprise any form of logic controller or logic control system including but not limited to a microprocessor, computer, controller, programmable logic controller, or programmable analog logic control system and can include sensors and actuators (not shown) that are positioned to sense conditions in z-fold signature finishing system 40 to cause movement and processing of signature print 34.

Finishing system controller 54 can include a communication system 56 that can enable wired or wireless communication with other devices such as printing system 10 or within z-fold signature finishing system 40. In embodiments where z-fold signature finishing system 40 is separate from a printing system 10 (not shown in FIG. 4) that supplies signature print 34 some or all of the functions of finishing system controller 54 can be provided by a controller in a printing system, such as printing system controller 32 of printing system 10.

One embodiment of a method for forming a signature 80 that can be practiced with the z-fold signature finishing system 40 and that can be executed in whole or in part by finishing system controller 54 will now be described with reference to FIGS. 3, 4, 5 and 6.

In the embodiment shown in FIGS. 3-6, a signature print 34 having page areas 36 arranged along a length of signature print 34 for a first side 35 and a second side 37 of the signature print 34 is received (step 60). In this regard supply 42 provides a signature print 34 and signature print 34 is guided by receiver system 44 from supply 42 and positioned for folding which can be done using active or passive guides such as rollers, rails, belts and the like. Supply 42 can comprise any system that can supply such a signature print 34 including, but not limited to, take-up roll 18 of FIG. 3, or a printing system such as printing system 10 illustrated in FIG. 3. Supply 42 can be integral with z-fold signature finishing system 40, modularly attached to z-fold signature finishing system 40 or separated from z-fold signature finishing system 40.

In the embodiment of FIG. 5, signature print 34 occupies an entire width of a web 6 of receiver medium 8 on which signature print 34 is printed and accordingly, receiver system 44 is positioned proximate to supply 42 to receive signature prints 34 that include the entire width of web 6 of receiver medium 8 on which the signature print 34 is formed. In other embodiments, for example, the embodiment that will be discussed further in respect to FIGS. 7A-7E signature print 34 can occupy only a portion of a width of a web 6, and in such an embodiment the signature print 34 is excised or separated from web 6 using, for example, cutting system 58.

An automatic z-fold system 46 is then used to form a z-folded stack 70 of sheets 74 having z-folds 55 across a width of signature print 34 at spaced locations along a length of signature print 34 (step 62). Each sheet 74 comprises a portion of the length L of signature print 34 and is joined to least one other sheet 74 in z-folded stack 70 by at least one of z-folds 55. In the embodiment of FIG. 5, z-fold signature finishing system 40 is used to induce z-folding of signature print 34 at the determined z-fold locations. In one example, z-folds 55 can be induced by providing equipment that folds the signature print 34. In the embodiment shown in FIG. 5, the automatic z-fold system 46 includes a z-folder 47 that mechanically folds signature print 34. Various types of folding apparatuses are known in the print finishing industry for creation and such equipment can be used in z-folder 47 to induce folding of the signature print 34 at determined locations along the length of the signature print 34. For convenience throughout this description z-folds 55 are illustrated as being positioned at respective z-fold locations. However, it will be appreciated that in practice, practical issues such as material and to be proximate to determined z-fold locations.

There are a number of well known mechanical methods that can be used to induce the folding of signature print 34 to fold at determined z-fold locations. In one embodiment, z-folder 47 has a set of reciprocating plates (not shown) of conventional design that cycle back and forth to crease signature 80 to induce folding at determined z-fold locations when, for example, signature print 34 is otherwise urged or allowed to move in a manner that allows the modified signature print 34 to form a z-folded stack 70.

In other embodiments, folding of signature print 34 can be induced by using a z-folder 47 that mechanically modifies signature print 34 to weaken signature print 34 such that signature print 34 has a variation in beam strength along length L of signature print 34 causing signature print 34 to fold proximate to the determined z-fold locations. Examples of such modifications include but are not limited to scoring or notching signature print 34, by removing material from signature print 34 or by applying materials such as plasticizers or solvents to signature print 34 to weaken signature print 34 in order to induce folding of the signature print 34 into a z-folded stack 70. In yet another embodiment, the z-folder 47 can mechanically weaken signature print 34 by impressing a pattern into signature print 34 such as a perforation pattern or a scalloped pattern using a roller with perforation teeth, a mechanism that provides a scalloped pattern, or other patterning device, for example. In still other examples, a signature print 34 can have a pattern of energy applied to weaken the signature print 34 to induce formation of z-folds 55. This energy can include but is not limited to that a pattern of heat or light that is selectively applied to weaken signature print 34 proximate to z-fold locations.

A signature print 34 can be sufficiently weakened using any of these or any other known weakening methods such that the signature print 34 will crease proximate the z-fold locations as the signature print 34 feeds into and is stacked within automatic z-fold system 46.

In still other embodiments, the folding of signature print 34 can be induced by applying materials to signature print 34 that expand or contract to induce folding. In one example of this type, it is known to apply toners to web 6 of receiver medium 8 during printing that contract when fused to induce bending of a signature print 34 that is provided with such materials. One example of the use of a material that contracts to induce bending is commonly assigned, co-pending U.S. patent application Ser. No. 12/845,789, entitled "Bending Receiver Using Heat-Shrinkable Toner," by Dinesh Tyagi, the disclosure of which is incorporated by reference herein. It will be appreciated that by inducing bending of a signature print 34 at a particular location enables z-folds 55 to be formed at the vertex of the bend such as by compressing or allowing the bent signature print 34 to become compressed.

Such expanding or contracting material can be applied for example during printing in a manner that causes the material to begin to expand or to contract at the time of printing or that can be activated after printing such as by the application of an activating material or energy by z-folder 47.

Similarly, in other embodiments, z-folder 47 can apply energy such as heat to signature print 34 to induce folding.

Automatic z-fold system 46 can also optionally include applying water at proximate to fold locations of a signature print 34 that has been printed on, for example, a paper type receiver medium 8 to make paper fibers or toner or toner at the z-fold locations more compliant to induce or facilitate folding at determined fold location without fracturing or splintering fibers in the paper. Alternatively, this can be done when there is toner on an opposite side of the fold so that the paper is more able to stretch or expand as may be necessary when toner is present between the two portions of a signature print 34 that are folded against each other. Methods for doing this are described in commonly assigned, copending U.S. application Ser. No. 12/771,287, filed Apr. 30, 2010, entitled: "FOLDING APPARATUS FOR ELECTROPHOTOGRAPHIC PRINTS" hereby incorporated by reference and generally describes systems for folding a receiver having a dry toner thermally fused thereon are provided. In one aspect, a system for folding has a wetting system adapted to apply water along a fold line and a fold mechanism folding the receiver along the fold line. The folding is performed after a predetermined absorption period during which at least a portion of the applied water is absorbed by the receiver to reduce the extent to which the receiver cracks proximate the fold line during folding and in commonly assigned, copending U.S. application Ser. No. 12/771,268, filed Apr. 30, 2010, entitled: "FOLDING METHOD FOR ELECTROPHOTOGRAPHIC PRINTS" hereby incorporated by reference. In this regard, printing system 10, receiver system 44 or z-folder 47 can be adapted to provide such water.

There are a variety of ways in which the location of z-folds 55 can be determined. In one embodiment, automatic z-fold system 46 can be adapted to support any of a plurality of different z-fold locations. In another embodiment, finishing data from which finishing system controller 54 can determine z-fold locations that can be provided to finishing system controller 54 by a printing system such as printing system 10 used to print the signature print 34. In one embodiment, this is done by using communication system 56 to exchange signals with communication system 33 in printing system 10. Alternatively, this can be done by way of communicating with electronic circuits such as radio frequency identification transponders, memory buttons or other memory devices known in the art that can, for example, be positioned on web 6, signature print 34 or take-up roll 18. In such embodiments communication system 56 will be adapted to communicate with such tags or memory devices.

In still other embodiments, visible or invisible indicia 88 (not shown in FIGS. 5 and 6) can be provided on signature print 34, on a portion of a web 6 of receiver medium 8 that is provided along with signature print 34 or on a portion of web 6 that can be observed by a reader such as reader 92 shown in FIG. 5 that is proximate to web 6 and that indicates locations along a signature print 34 that a printing system controller 32 has determined are to have z-folds 55. Alternatively such indicia 88 can provide information that can be read by reader 92 and provided to finishing system controller 54 from which finishing system controller 54 can determine where z-folds 55 are to be located.

The z-folded stack 70 is bound across a width of the z-folded stack 70 proximate to a saddle fold location 72 (step 66). In the embodiment shown of FIG. 5, this is done at a binding system 48 having a binder 76 that is used to bind stack sheets 74 of signature print 34 in a manner that will hold z-folded stack 70 together proximate the saddle fold location 72. In one embodiment, binder 76 can use mechanical fasteners such as staples, wires, stitching, threads, loops, screws, nails, and the like to bind the z-folded stack 70 of sheets of signature print 34. U.S. Pat. Pub. 2006/0292939 entitled: "METHOD FOR MANUFACTURING BOUND PRINTED PRODUCTS SUCH AS BOOKS, JOURNALS, MAGAZINES, AND THE LIKE, PERFORMED AT LEAST PARTIALLY DEPENDENT ON A WORKING CYCLE", filed by Grunder et al on Aug. 25, 2006 describes one approach to saddle stitching in detail.

In another embodiment, binder 76 can apply an adhesive to bind the z-folded stack 70 of sheets of signature print 34. Such an adhesive can comprise a conventional adhesive material such as glue, hot glue, an adhesive toner, an epoxy or other adhesive material. In still other embodiments binder 76 can activate a binding agent printed or otherwise supplied on the portions of the z-folded stack 70 proximate to the saddle fold location 72.

Another example such a binding agent is a toner that can be printed at or proximate to the saddle fold location 72 and heated by the application of heat by binder 76 in a manner that causes the toner to bind to any portion of signature print 34 that are in contact. Binder 76 can additionally use any other conventionally known method or mechanism to bind the stack. A variety of methods for using binder 76 to form an adhesive that can bind sheets are known to those of skill in the art.

The saddle fold location 72 is typically at a midpoint between the z folds 55 of z-folded stack 70, but is not limited to such a location and can vary to provide different creative types of signatures 80.

The z-folded stack 70 is saddle folded across a width of z-folded stack 70 proximate to the saddle fold location 72 (step 66). Such folding can be performed in any conventional manner. In the embodiment that is illustrated in FIG. 5, a saddle fold system 50 is shown that uses platens 51 that are automatically moved about pivot points 53 by actuators 57 to saddle fold the z-folded stack 70 proximate the saddle fold location 72 to dispose z-folds 55 along a common side of the saddle folded stack 78 formed by saddle folding the z-folded stack 70. In other embodiments, at least two surfaces arranged so that the at least two surfaces and the z-folded stack 70 can move relative to each other to cause the z-folded stack 70 to fold proximate to the saddle fold location 72 to dispose z-folds 55 along a common face 82 of the saddle folded stack 78. This can be done, for example where the two surfaces are sloped or curved to cause the z-folded stack 70 to cause folding proximate the saddle fold location 72 as the z-folded stack 70 moves relative to the surfaces, or this can be done moving the surfaces relative to each other, and in still other examples this can be done through a combination of approaches.

Signature print 34 is then separated proximate at least one of z-folds 55 to provide turnable pages, page areas 36 on the first side 35 and the second side 37 of the separated signature print portions (step 68). In the embodiment shown in FIG. 5, a trimmer 84 is used to trim all of z-folds 55 from a common face 82 of saddle folded stack 78 to form a signature 80. It will be appreciated that this trimming can be accomplished along a single axis of trimming and therefore such trimming can be accomplished quickly and will not suffer from the difficulties associated with multi-axis trimming required by the conventional method of forming a signature 240 discussed above.

Figure 6:
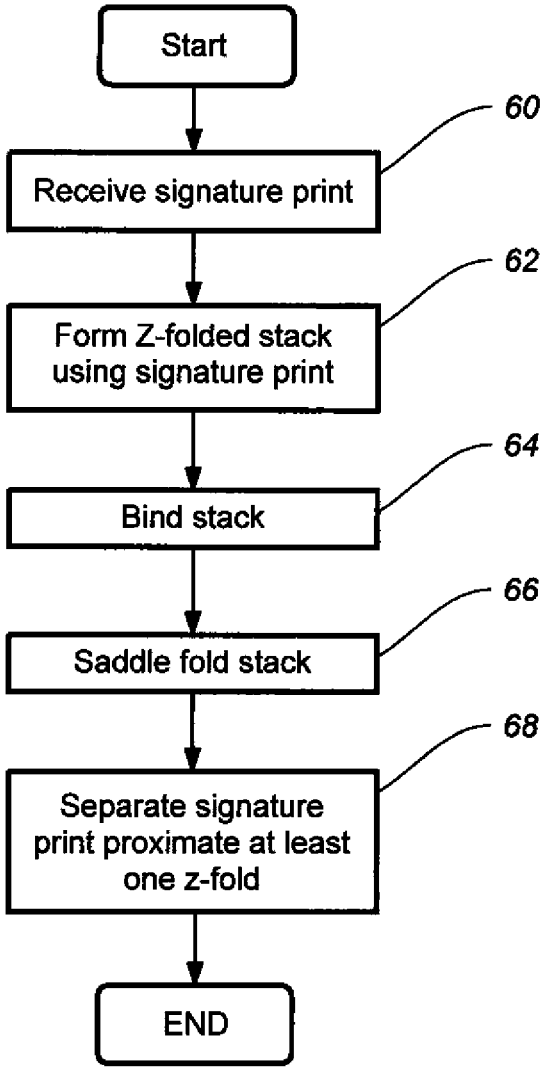
FIG. 6 is a block diagram showing a method for forming a signature.

It can be appreciated that there are a number of possible variations of the method of FIG. 6 and the embodiment of z-fold signature finishing system 40 shown in FIG. 5. In one example, where z-fold signature finishing system 40 is separate from printing system 10 and receives signature print 34 from known forms of supply other than a take up roll 18. These can include for example, a stack, cartridge, or tray. Similarly, the order of binding (step 66) and saddle folding (step 68) can be reversed in some embodiments.

Figure 7B:
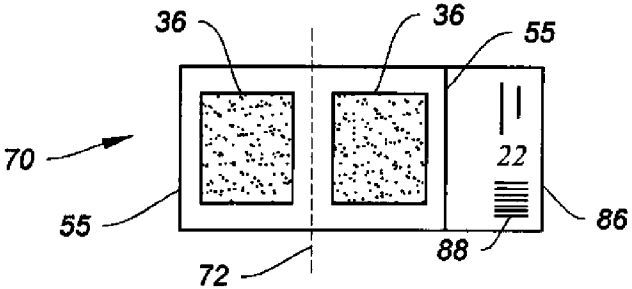
FIGS. 7A-D shows aspects of one example of a finishing operation using an embodiment of the method of FIG. 6.
Figure 7C:
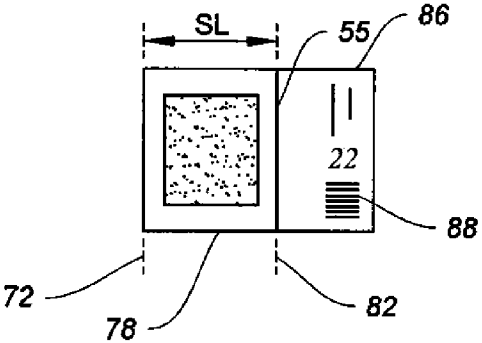
Figure 7A:
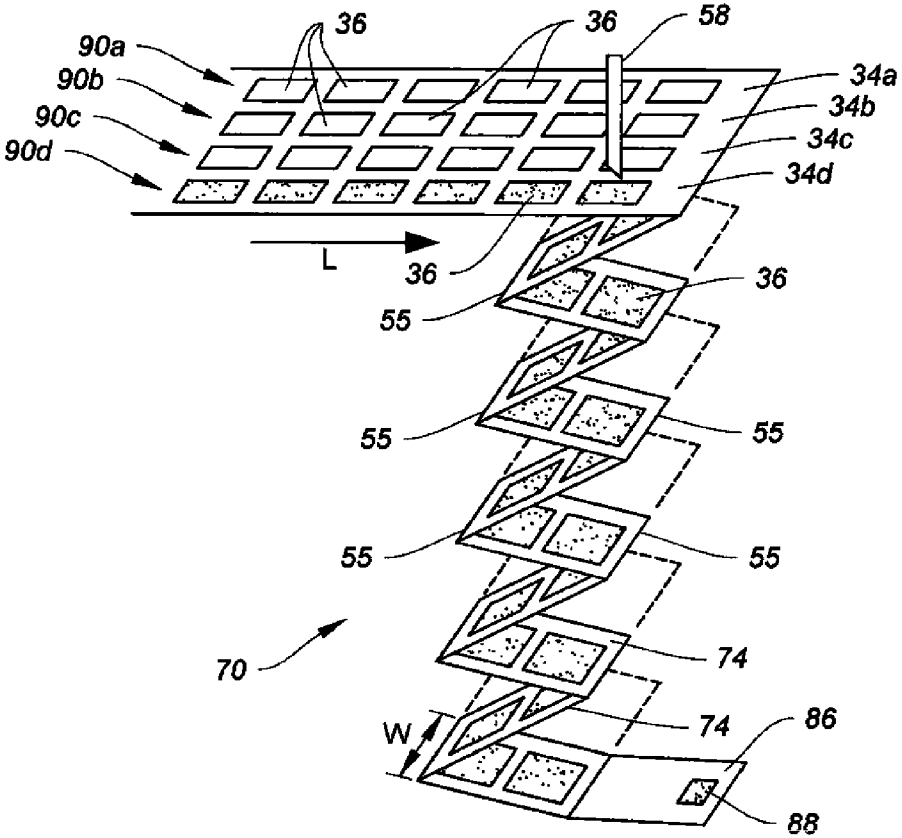

FIGS. 7A-7C show one example of the method of FIG. 6 as applied to a web 6 of receiver medium 8 having a plurality of signature prints 34 shown as signature prints 34*a*, 34*b*, 34*c*, and 34*d* recorded across different portions of web 6 of receiver medium 8. As is shown in FIG. 7A, in this example, web 6 of a printed receiver medium 8 has page areas 36 that are arranged in rows 90*a*, 90*b*, 90*c*, and 90*d* that extend along a length L of signature print 34. Each of rows 90*a*, 90*b*, 90*c*, and 90*d* contains page areas 36 for signature prints 34*a*, 34*b*, 34*c*, and 34*d* respectively. Accordingly, in this example, the step of receiving the signature print 34 (step 64) further comprises slitting a width of receiver medium 8 from web 6 that contains one of signature prints 34*a*, 34*b*, 34*c* or 34*d*, shown here as signature print 34*d*. As is shown in this example, cutting system 58 is used for this purpose and cutting system 58 can have a knife arrangement or other known device that can be arranged to sever a first width of web 6 to separate signature print 34 from other portions of web 6. Examples of cutting system 58 include wheel cutters, knives, keel knives, slitters, laser cutters, and water based cutters. Cutting system 58 can also be used to define a length of signature print 34 by selectively cutting across the width of web 6 at a leading or at a trailing edge of signature print 34.

The extent of, type of and locations of cutting provided by cutting system 58 can be determined based upon user inputs received at any conventional user input device associated with z-fold signature finishing system 40 or these parameters can be determined automatically by finishing system controller 54 which can drive conventional actuators (not shown) to bring one or more differently positioned cutters of cutting system 58 into or out of engagement with a web 6 of receiver medium 8 as desired or finishing system controller 54 can cooperate with conventional sensors, actuators and movement control systems to dynamically position one or more cutting systems across a web 6 so that a wide range of print width options is provided.

As is also shown in FIG. 7A, signature print 34*d* is then automatically folded across a width W of signature print 34*d* at a plurality of locations along the length L of signature print 34*d* to form a z-folded stack 70 of sheets 74 having two page areas 36 on each side (step 64). The z-folded stack 70 is then bound proximate to a saddle fold location 72 and folded proximate to saddle fold location 72.

As is shown in FIGS. 7A-7C, each z-fold 55 lies between page areas 36 on adjacent sheets. In other embodiments page areas 36 can extend to each of the z-folds 55, to provide printing that extends to an edge of a page of saddle folded stack 78 formed using signature print 34. Folding bound z-folded stack 70 proximate to saddle fold location 72 disposes each z-fold 55 along a common face 82, as shown in FIG. 7C. Common face 82 is then trimmed to convert saddle folded stack 78 into a signature 80. In this embodiment, this single trimming operation is the only trimming of saddle folded stack 78 that is required to separate signature print 34 proximate to z-folds 55 to form a signature 80 having a desired number of pages. As is also shown in FIGS. 7A, 7B, and 7C, a metadata tag 86 can be provided that can bear indicia 88 that can be read by reader such as reader 92 shown in FIG. 5, and that can be used by finishing system controller 54 in determining how to operate z-fold signature finishing system 40.

Reader 92 is used to read or otherwise detect an indicia 88 in on a web 6 or on a signature print 34 and to provide signals based upon the detected indicia 88 to finishing system controller 54. Finishing system controller 54 uses the signals provided by reader 92 to determine locations for z-folds 55 along the length of signature print 34. Finishing system controller 54 can also consider other factors in determining where z-folds 55 are to be located and such factors can include, for example and without limitation, paper type of the signature print 34, number of pages to be made in a signature and related factors. As is discussed generally above, indicia 88 can be provided on metadata tag 86 portion of a web 6 that is used for printing of signature print 34 that is received and processed with signature print 34 (FIG. 8) or that is provided on the first page or any suitable page of signature print 34 or can be provided on a portion of a web 6 of receiver medium 8 that is proximate to signature print 34 but not part of signature print 34.

In the example of FIGS. 7A-7C, indicia 88 takes the form of a bar code on metadata tag 86 attached to signature print 34 and accordingly reader 92 takes the form of a bar code reader. Here, indicia 88 on metadata tag 86 contains identifying data and optionally some part or all of the information needed for finishing. Examples of such information can include, but are not limited to, parameters that at least in part define the signature 80 to be formed using signature print 34 including but not limited to page length, page height, number of pages, trimming specifications, special binding instructions, and the like, as well as destination or customer data, billing information, and other data about the signature or signatures on the printed output that follows.

In an alternate embodiment, indicia 88 is encoded essentially invisibly in the printed output, such as using inks that are readable only under ultraviolet (UV) light or by using a steganographic digital encoding scheme that modulates the printed image data imperceptibly to the human eye, but in a manner that can be automatically detected by analysis of a scanned image of the printed output. Digital encoding schemes of this type are known to those skilled in the imaging arts. One example of a steganographic image marking technique is described in commonly assigned U.S. Pat. No. 5,905,819, entitled: "METHOD AND APPARATUS FOR HIDING ONE IMAGE OR PATTERN WITHIN ANOTHER" issued May 18, 1999 to Daly. In certain embodiments, multiple readers 92 can be provided, with each of the multiple readers 92 reading different types of indicia 88 and with each reader providing signals that are indicative of the indicia 88 read to finishing system controller 54. It will be understood that information recorded in any type of indicia 88 can be read and used by finishing system controller 54 to control any aspect of the finishing of a signature print 34.

Figure 7D:
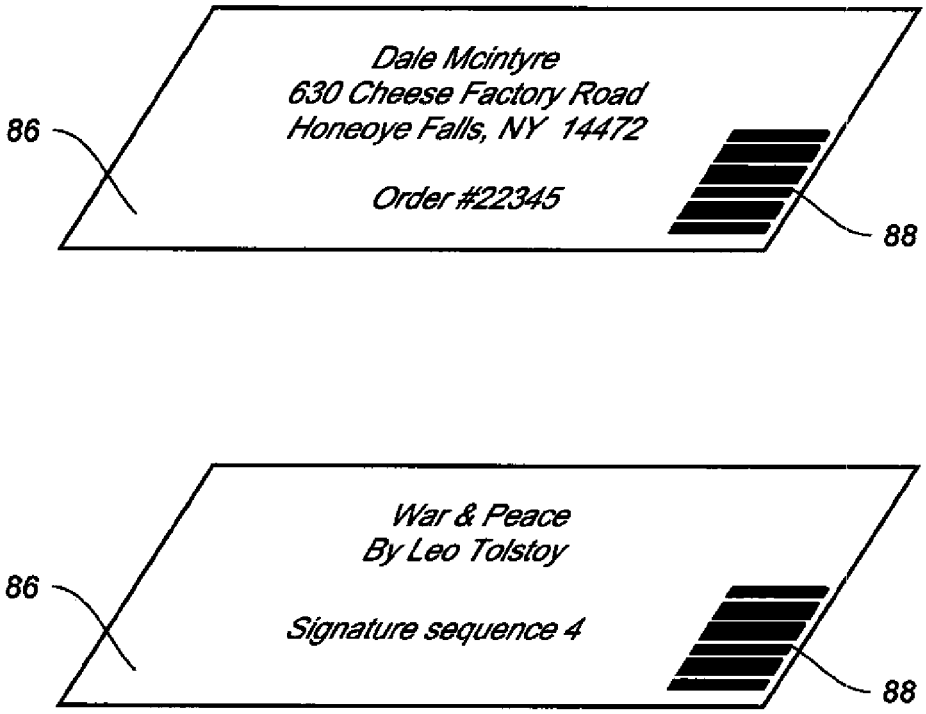

As is shown in FIG. 7D, metadata tag 86 can also be used for other purposes such as to associate delivery or other information with signature print 34.

Figure 2A:
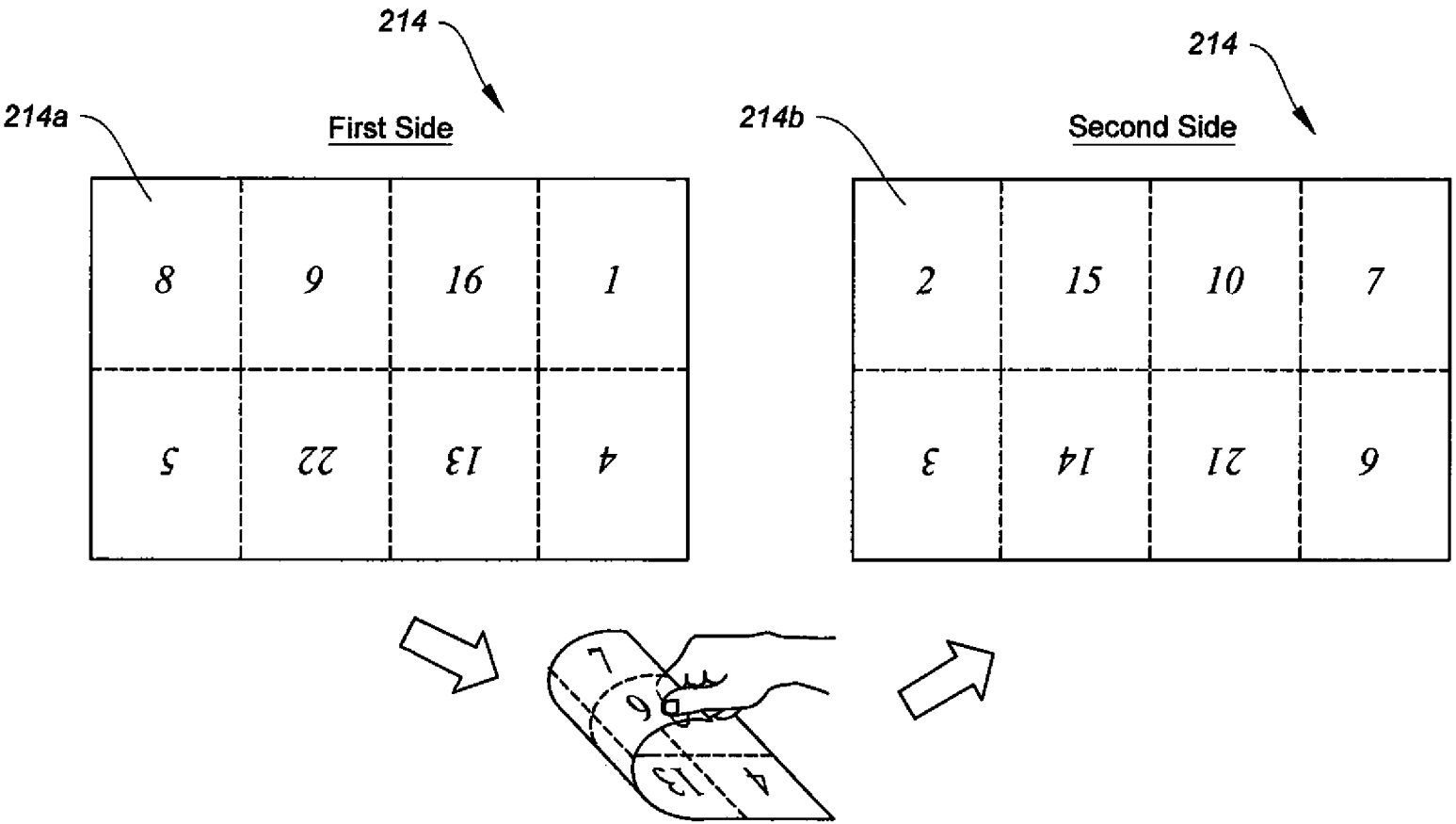
FIG. 2A (Prior Art)
FIG. 2A is a plan view that shows front and back side imposition arrangements for a conventional saddle-stitched signature.
Figure 2B:
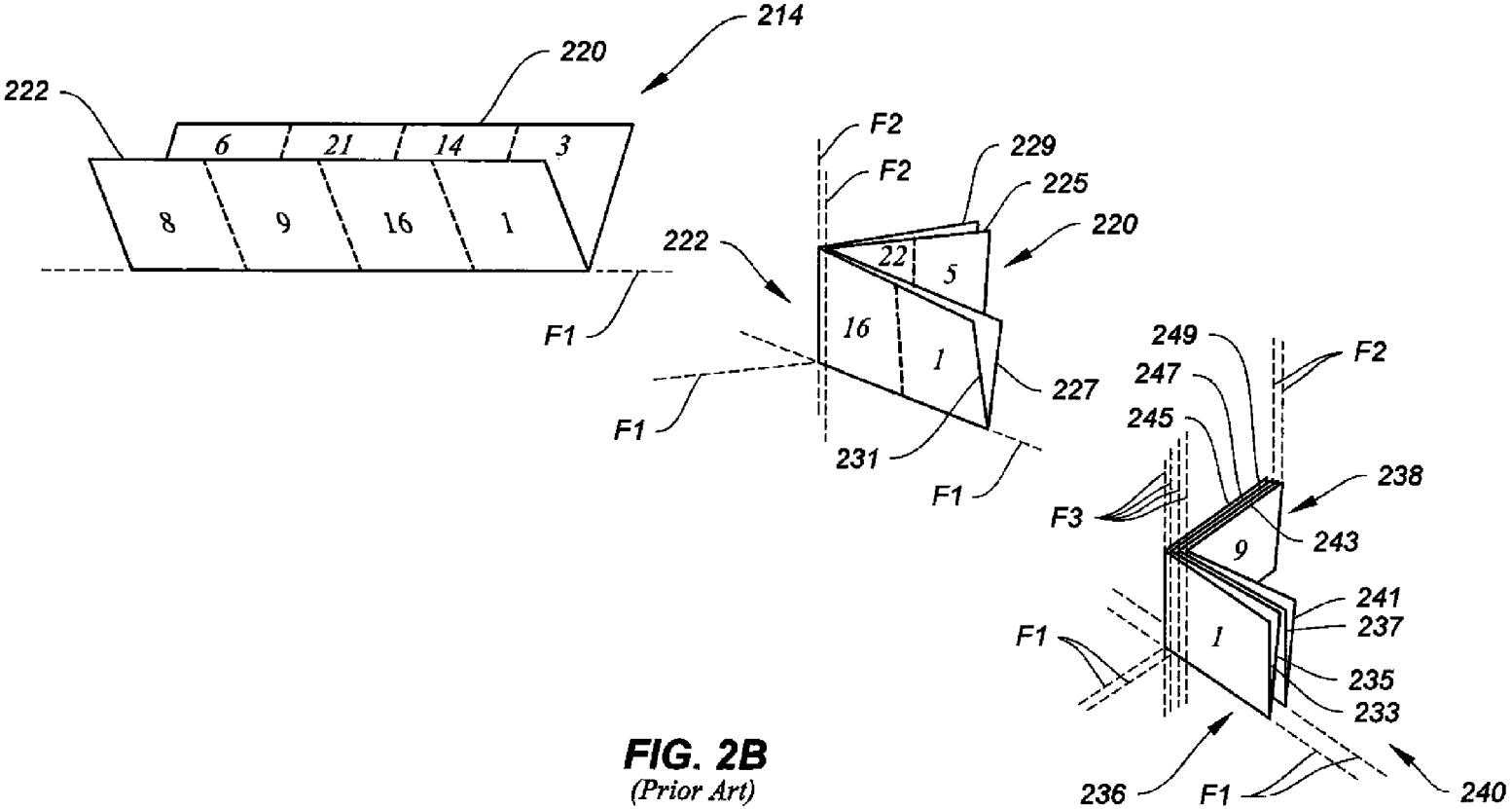
FIG. 2B (Prior Art)
FIG. 2B is a diagram that shows the conventional folding sequence for a 16-page signature.
Figure 2C:
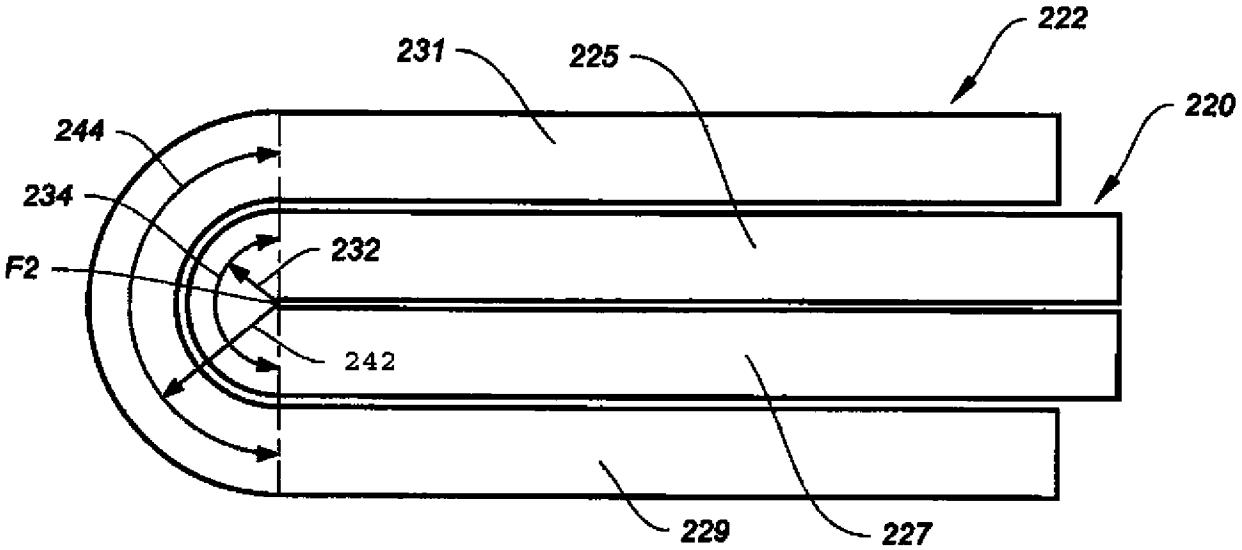
FIG. 2C (Prior Art)
FIG. 2C is a cross-section diagram of sheets that are folded in parallel during a fold in the conventional folding sequence.

It will be appreciated that by using z-fold signature finishing system 40 methods of FIG. 6, a signature 80 can be formed from a signature print 34 shown in FIG. 4 and in FIGS. 7A-7C that does not conform to the conventional signature printing used for half-sheet folded signatures as discussed in greater detail in the example of FIGS. 2A and 2B.

In particular, arrangement of page areas 36 in a sequence along a length of a signature print 34 and the use of a z-fold signature finishing system 40 or the methods described herein enables the task of printing and finishing of a signature 80 having a number of pages other than the 4, 8, 16 and 32 page options that can be readily formed using a half-sheet folding process For example, if the half-sheet folding process of prior art described above is used to print a signature having twenty printed pages, either a full thirty two page signature must be made with all of the size and aspect ratio compromises that are associated with this process and twelve of the thirty two pages will be discarded. Alternatively, the printer can generate two sixteen page signatures and to discard twelve pages the two sixteen page signatures. In contrast, it is less complex to define signature print 34 with a length L that is sufficient to provide twelve page areas 36 of signature print 34 on a first side 35 and to provide a corresponding ten page areas 36 a second side 37 of signature print 34 and to use the z-fold signature finishing system 40 or the methods described herein to form a signature 80. Where this is done, only two page areas are unnecessary and these can be left blank as a back cover so as to remove the need to separate these from the signature 80.

For example, FIGS. 8A-8E show a sequence for forming signature 80 for having twelve page areas, consistent with an embodiment of the present invention. As is shown in a top perspective view in FIG. 8A and in a cross section view, in this example, a signature print 34 is provided having six page areas (P8, P5, P9, P4, P1 and P12) arranged along a length L in a single row on a first side 35 and having six page areas (P7, P6, P10, P3, P2 and P11) in a single row on a second side 37. As is shown here, z-folding induces z-folds 55 that convert the signature print 34 stack to form a z-folded stack 70 of sheets 74.

Figures 8A, 8B, 8C, 8D, 8E:
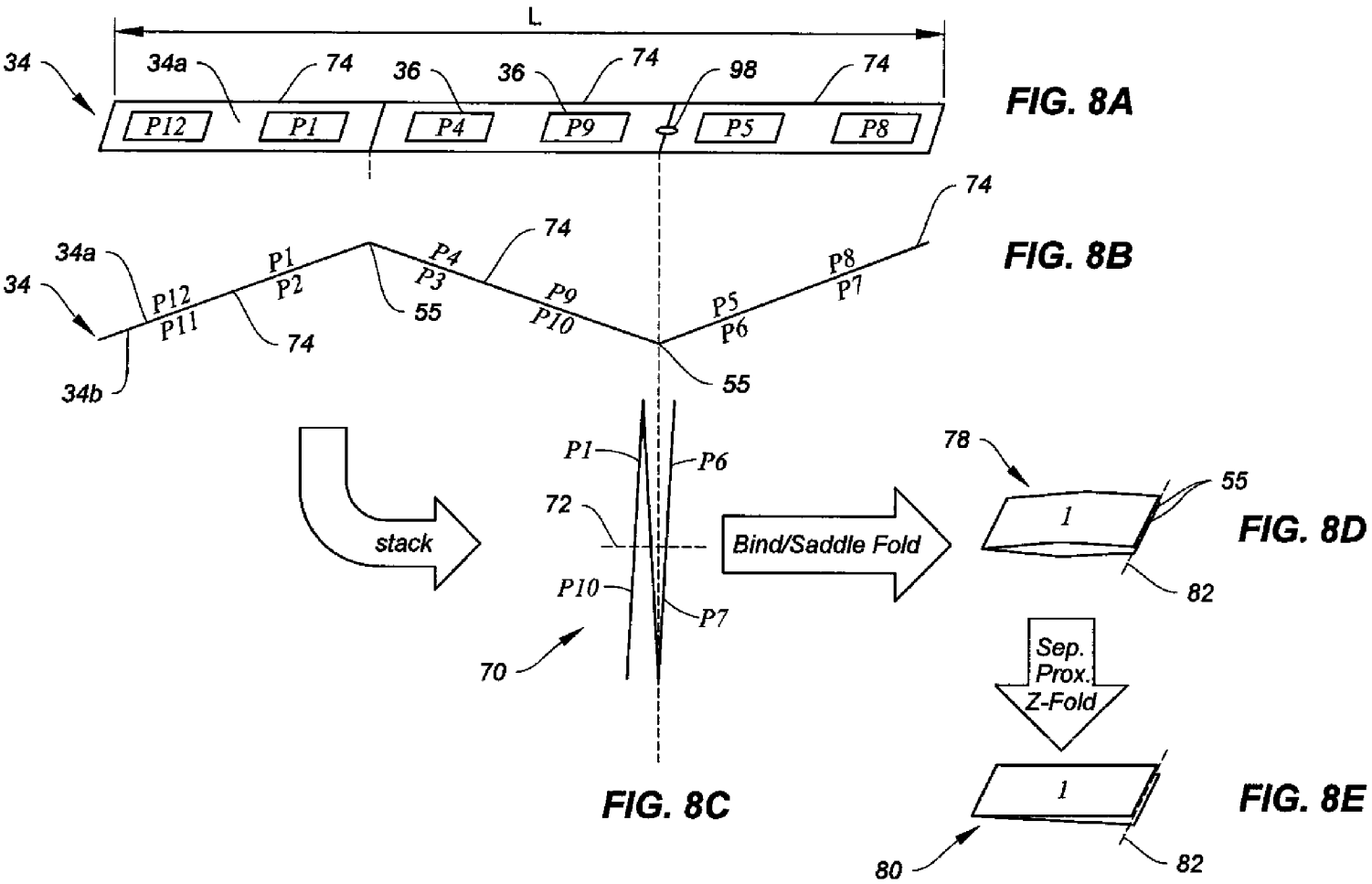
FIGS. 8A-8E collectively illustrate forming a twelve page signature according to one embodiment.

The sheets 74 of z-folded stack 70 are bound together and saddle folded together along saddle fold location 72. A folding operation folds the z-folded stack 70, positioning z-folds 55 (two in the 12-page example shown) at a common face 82, this forms a saddle folded stack 78 one example of which is shown in FIG. 8D. Z-folds 55 are then separated by a trimming operation to form signature 80 as is shown in FIG. 8E.

The embodiments of z-fold signature finishing system 40 and the methods described herein also enable printing with different page lengths. This can be achieved, for example by, varying the distances between z-folds 55. Further, z-fold signature finishing system 40 and the methods described herein make it possible to adjust page widths to the extent that cutting system 58 can be adjusted to cut a signature print 34 from a web 6 at any plurality of different slitting widths arranged across a width of web 6. This capability can be used to provide a range of desired widths for signature print 34. When such features are enabled in combination, it becomes possible to provide a wide range of flexibility as to the aspect ratio (width/height) of a signature 80. This in turn provides increased flexibility and creative opportunities that cannot be matched by plate based printing and finishing systems or by finishing systems that rely on half-sheet folding processes of the prior art.

The z-fold signature finishing system 40 and methods that are described herein are further more adept at efficiently making booklets or signatures 80 having a smaller page size or using stiff paper, such as for a booklet containing a set of printed photographic images, for example, as the number of cross folds or folds across another fold is limited.

Figures 9A, 9B, 9C, 9D, 9E:
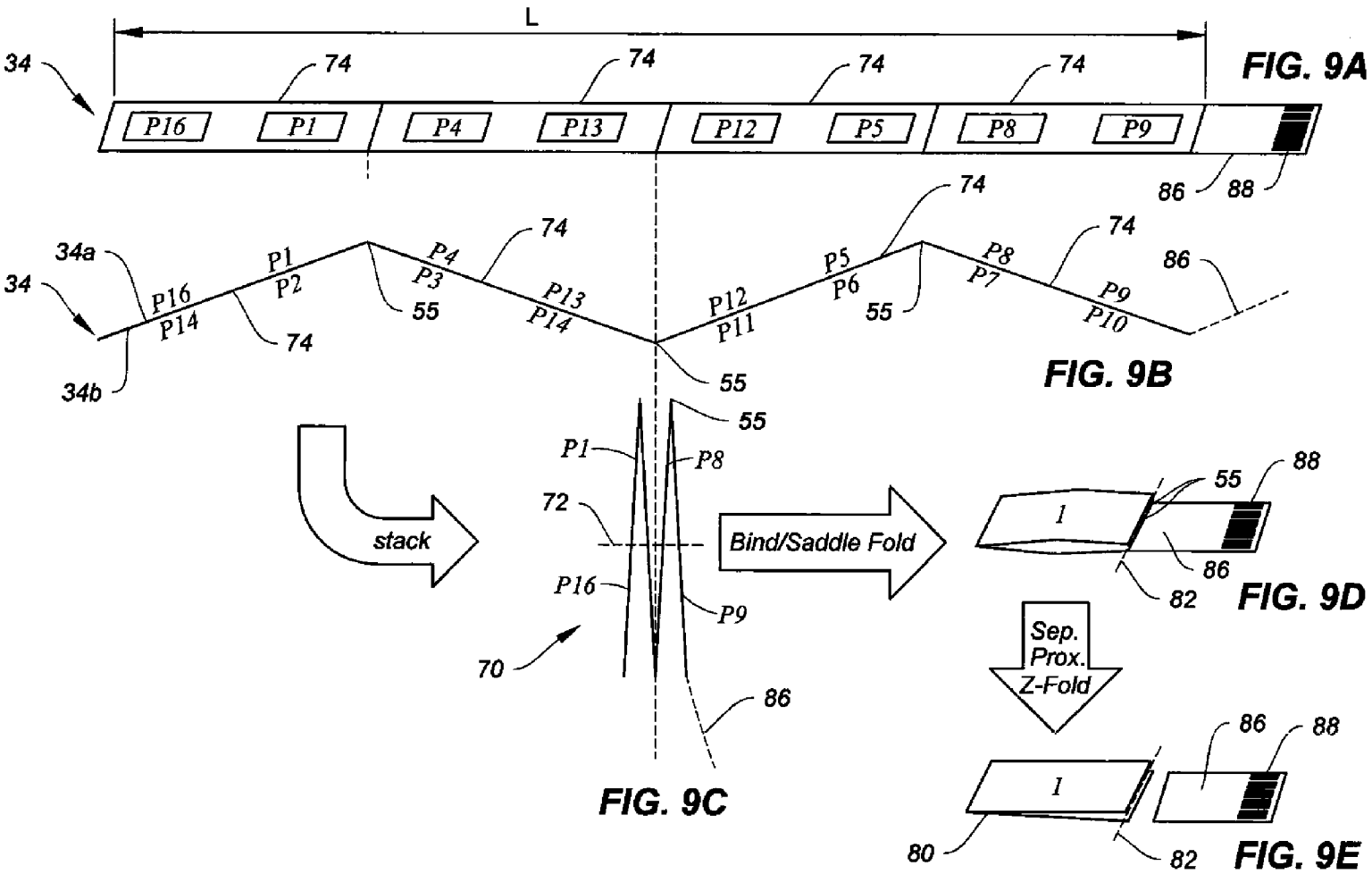
FIG. 9A-9E collectively illustrate forming a twelve page signature according to one embodiment.

FIG. 9A-9E collectively show the steps of one embodiment for in making a sixteen page signature 80 according to the same basic sequence described with reference to FIGS. 8A-8E with the addition of an optional metadata tag 86. In the embodiment, of FIGS. 9A and 9B illustrate signature print 34 is to be used to form sixteen sequential pages P1-P16. To achieve this outcome using a z-fold signature method, these pages are arranged along length L of signature print 34 as is indicted in pages P1-P16.

As is also shown in FIGS. 9A and 9B metadata tag 86 is provided in the form of a "leader" that is, metadata tag 86 is on a portion of a continuous web (not shown) printed immediately before and joined to a leading edge of signature print 34. Alternatively, metadata tag 86 can be printed with previous signature print 34, or may be printed as a "trailer" after the signature print 34. As is shown in FIGS. 9A, 9D and E, in this embodiment, metadata tag 86 has indicia 88 that provides some type of information about a signature 80 to be formed using signature print 34. Metadata tag 86 can remain attached to z-folded stack 70 as z-folded stack 70 is saddle folded and bound and it can be separated during the separation process as is depicted in FIGS. 9D and 9E respectively. Optionally, metadata tag 86 can be separated from z-folded stack 70 during earlier steps if desired. In other embodiments, metadata tag 86 can be used as a wrapping for signature 80, and can print with shipping or other destination information, for example.

In the embodiment that is shown in FIGS. 9A-9E, indicia 88 takes the form of a bar code that is used to provide or to enable finishing system controller 54 to determine or obtain information regarding a signature 80. Such information can include a number of pages in signature 80 to be made from signature print 34, a length of signature print 34, the page lengths and page widths of signature 80 to be formed using signature print 34 and desired z-fold locations, the location of z-folds 55 at which signature print 34 is predisposed to fold, information from which finishing system controller 54 can determine an intended use for the signature and to adjust the finishing process to support such an intended use and any information that can help finishing system controller 54 to determine how to further process the signature print 34 in any way to form a signature 80 including but not limited to information that can be used, for example, to instruct cutting, folding, stitching, and final trim operations.

The z-fold signature finishing systems 40 and the methods that are described herein can be used to provide increased flexibility with respect to the width of the signature print 34, and accordingly the width of the signature 80 so formed as well as the length of the pages of the signature 80. Such flexibility is not possible with the prior art method. However, it will be appreciated that in certain situations, there can be cost, size, efficiency, production rate or other advantages to reducing the number of or in adjusting the character of operations that are performed by z-fold signature finishing system 40 or that are performed in a method for generating a signature 80. The following drawings illustrate some examples of different arrangements that can be used with the z-fold finishing system 40 and methods that are described herein.

Figure 10:
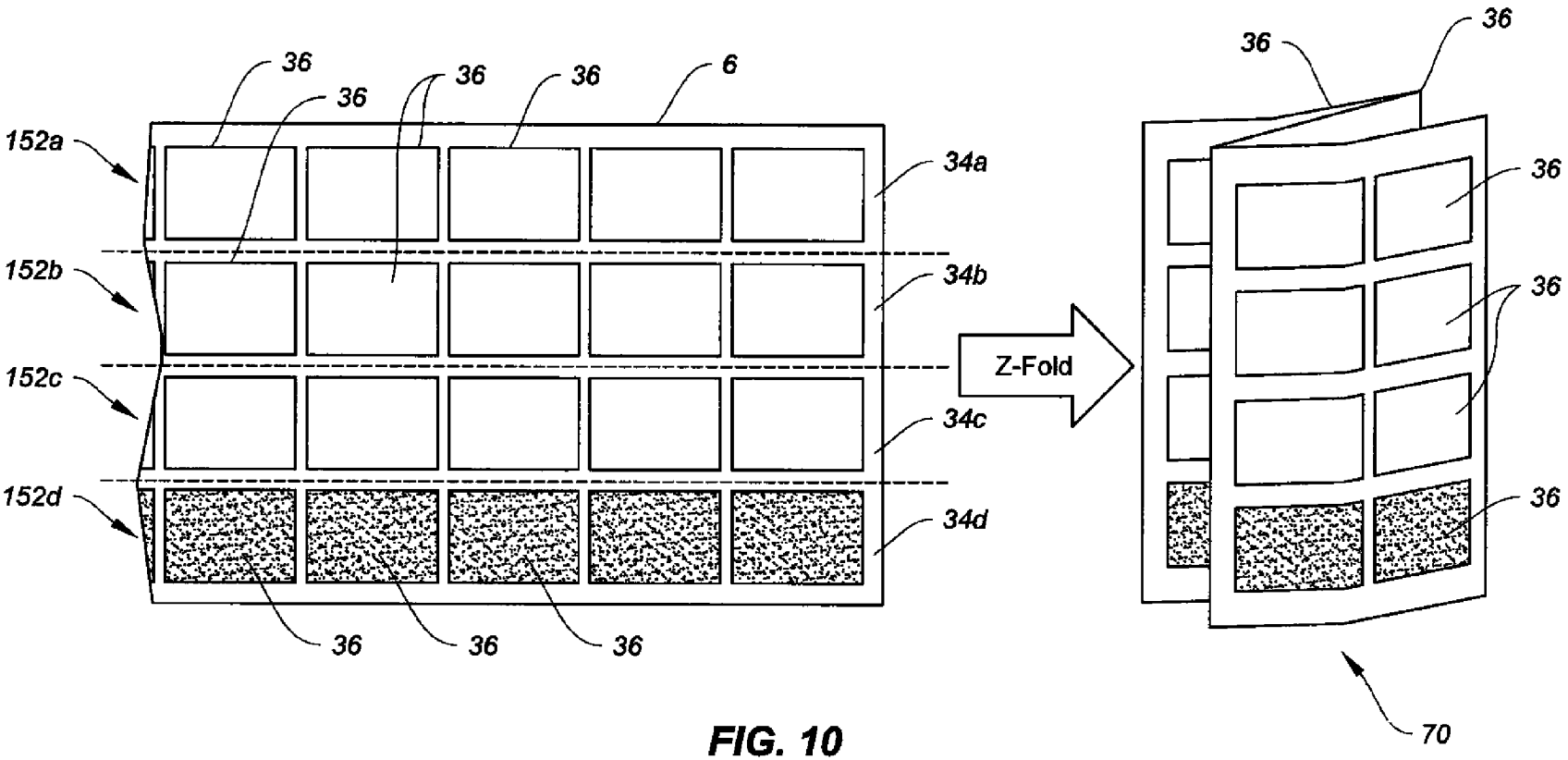
FIG. 10 shows an alternate embodiment for making a signature.

FIG. 10 illustrates one example of such an alternative arrangement. As is shown in FIG. 10, the step of forming a z-folded stack 70, the z-folding and receiving step can be reversed. For example, an web 6 having multiple signature prints 34*a*, 34*b*, 34*c*, and 34*d* can be z-folded with separation of respective signature prints 34*a*, 34*b*, 34*c*, and 34*d* from web 6 being performed after z-folding. It will be appreciated that z-fold signature finishing system 40 and the methods described have the flexibility to receive and process a web 6 bearing more than one signature print 34 and that this provides a great degree of flexibility in the finishing process.

Figure 11:
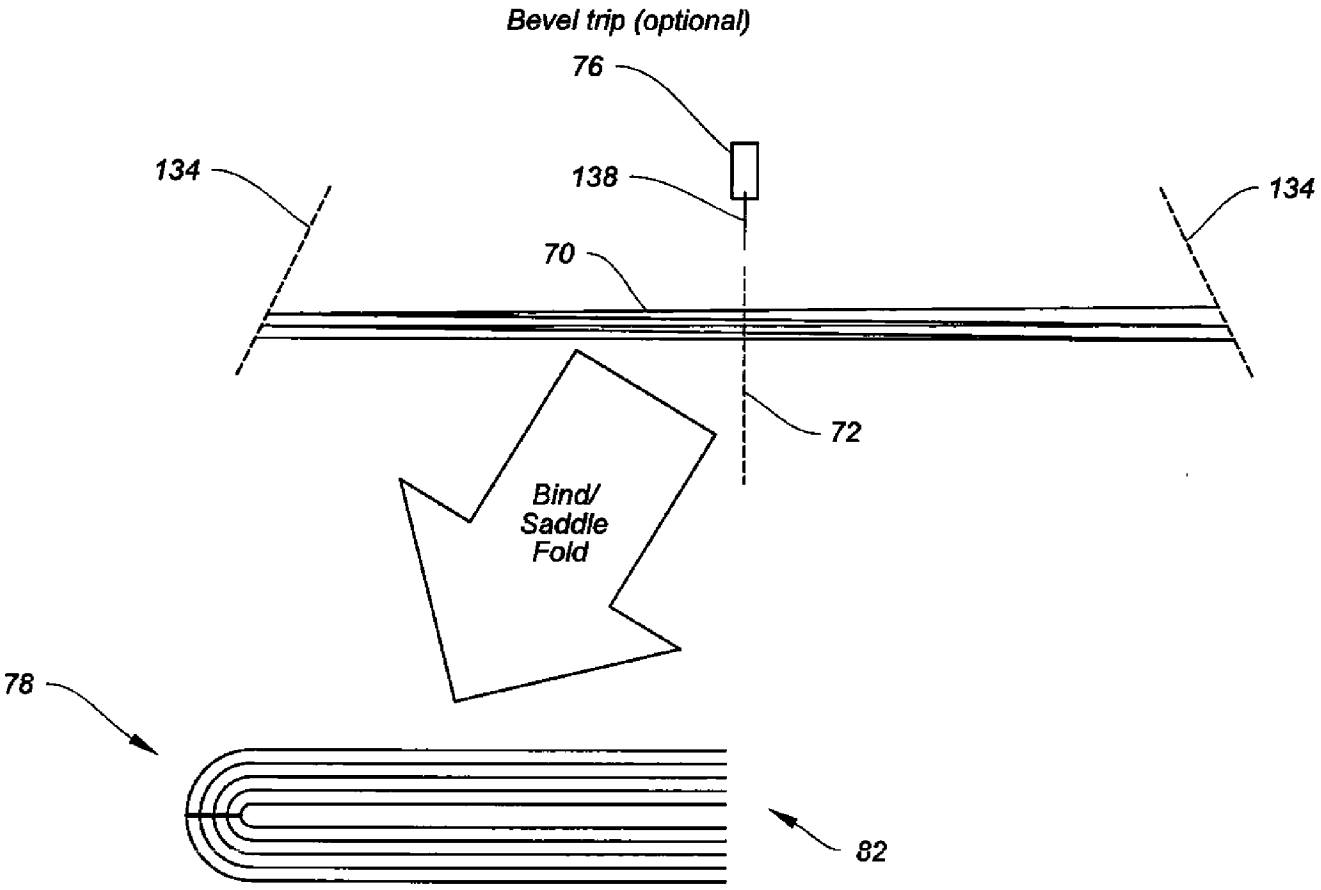
FIG. 11 shows a bevel cutting operation for creep compensation.

FIG. 11 illustrates another example of an alternative arrangement. In the example of FIG. 11, binding and separation steps are performed before saddle folding. In the example shown, z-folded stack 70 is bevel cut along cut lines 134. Here bevel cut lines 134 are angled to cause the different pages of the saddle folded stack 78 that will be formed by binding and saddle folding the z-folded stack 70 to have different page lengths in order to counter the effects of creep so that common face 82 of saddle folded stack 78 has a determined face profile. As is shown in FIG. 11 this profile is generally perpendicular to the stacking plane at which of saddle folded stack 78. Such bevel cutting is preferably done after binder 76 binds z-folded stack 70. In this example, binder 76 uses a staple 138 to bind z-folded stack 70. As is shown, this approach makes it possible to achieve a determined profile at common face 82 that will be similar to or the same as a determined profile that can be achieved by trimming a saddled folded stack 78. This approach can avoid the use of a trimming type separation step as a final step in the production of a signature 80. This can be done for example so that cutting waste and related debris can be created and managed apart from the point of delivery of a finished product to allow better containment of such waste and debris. Such bevel cutting may require more than one cutter; however, the required cutting is done in parallel. This allows such cutting to be performed, for example, without interrupting movement of a z-folded stack 70 along a transportation path (not shown in FIG. 11). Although not shown, it should be obvious that a clamping operation holds the z-folded stack in a fixed position during the cutting operation. It will be appreciated that this approach advantageously performs both the functions of separating the signature print 34 at the z-folds 55 and creep compensation in the same step.

However, in other embodiments it can be useful to separate these steps. For example, in various embodiments that will be described in greater detail below, a common face 82 having a determined profile is formed by folding signature print 34 such that sheets 74 have lengths that are determined to cause z-folds 55 to form the determined profile at common face 82 after saddle folding. For example, it will be understood that the length of any sheet 74 between two z-folds 55 can vary from a length of a preceding sheet 74 or a following sheet 74 and, in this regard, variations in page length can be planned, for example, by finishing system controller 54 to reduce the extent to which creep exists in a saddle folded stack 78 so as to provide a common face 82 with z-folds 55 that provide a determined profile. Where this is done, finishing system controller 54 can provide pages that are calculated to extend more or less than adjacent pages as may be desired or useful to satisfy the requirements of a particular print job and thus eliminate the need for cutting or trimming z-folds 55 from a z-folded stack 70 or saddle folded stack 78. It will be appreciated that such embodiments, increase the number of options that are available to achieve separation proximate to z-folds 55 and, importantly, removes the requirement that such separation be performed using cutting tools. The availability of non-cutting options for performing the separating step can be seen as advantageous for example for cost, noise or waste management reasons.

Figure 12:
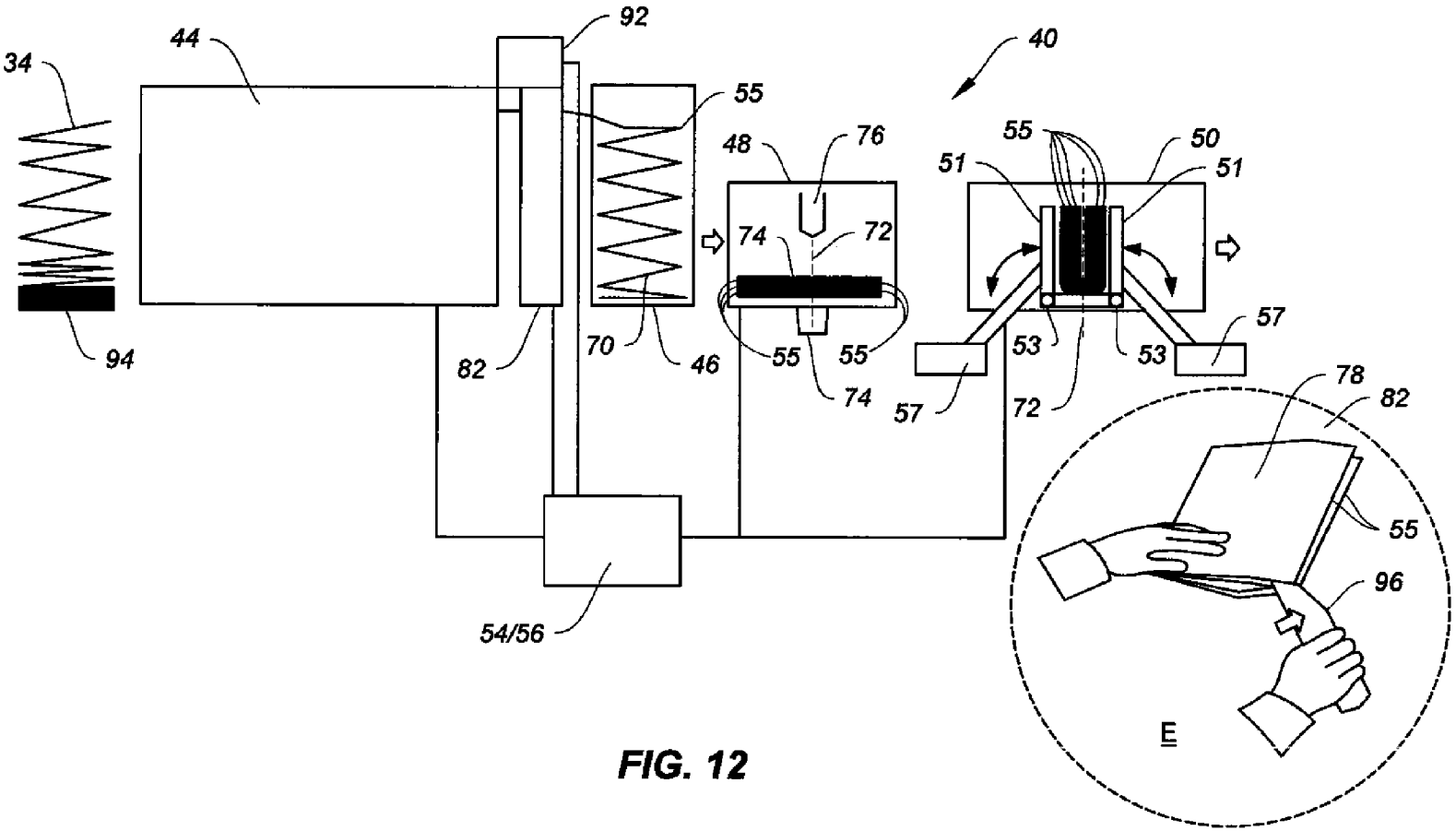
FIG. 12 shows an alternate embodiment of a z-fold finishing system.

FIG. 12 illustrates another example of an alternative embodiment. In this embodiment, a signature prints 34 is used that is predisposed to fold at z-fold locations before signature print 34. This can be done, for example, by processing a receiver medium 8 before printing or during printing so that the signature print 34 formed will tend to form z-folds 55 at determined z-fold locations.

It will be appreciated that this reduces the number of steps that must be performed in forming a z-folded stack 70 of sheets 74 using a signature print 34 and can reduce the cost of a z-fold signature finishing system 40. In particular, this approach can eliminate tasks of determining z-fold locations for a signature print 34 and inducing z-folds 55 at the z-fold locations. This can also eliminate the need to provide a z-fold signature finishing system 40 that incorporates automated equipment such as z-folder 47 that can rapidly make such determinations and then accurately induce the z-folds 55. This can eliminate the need for relatively complex equipment that may not be practical in all applications.

Accordingly, in the example of FIG. 12 what is shown is an embodiment of a signature print 34 that is predisposed to fold to form a z-folded stack 70 and a z-fold signature finishing system 40 that is adapted for use with this embodiment of signature print 34. In this embodiment, signature print 34 is pre-folded into a z-folded stack 94 and, unless urged otherwise signature print 34 tends to return to this configuration when moved from z-folded stack 94 to automatic z-fold system 46. Therefore in this embodiment, automatic z-fold system 46 is not required to induce z-folds 55 in signature print 34. Instead, automatic z-fold system 46 allows or urges signature prints 34 to fold in z-fold locations that the signature print has been pre-disposed to fold at. This allows such a pre-disposed signature print 34 to be used to form a z-folded stack 70 having precisely located z-folds 55 but does not require that z-fold signature finishing system 40 provide systems that can either make determination of the locations of z-folds 55 to form a signature or a z-folder 47 that can fold signature print 34 at the determined locations.

In the embodiment, of FIG. 12, signature print 34 is predisposed to form a z-folded stack 70 by folding signature print 34 to fold into a z-folded stack 94 that corresponds to z-folded stack 70 before signature print 34 is supplied to z-fold signature finishing system 40, this mechanically predisposes signature print 34 fold back into this shape. However, in other embodiments, a signature print 34 can be predisposed to fold at z-fold locations as is shown in FIG. 12 in ways other than actually folding the signature print 34. In this regard, any other known method for processing a signature print 34 to induce the formation of z-folds 55 can be used including any of those that are described above. For example, various embodiments described above induce z-folding of a signature print 34 by way of processing signature print 34 by/modifying signature print 34, or by adding materials to signature print 34 that can be activated during or after printing to induce folding of a signature print 34. A signature print 34 can be predisposed to fold using any of these embodiments during or after printing. In such embodiments, automatic z-fold finishing system can have a z-folder 47 that activates the material so that the material can cause the signature print 34 to z-fold.

In other embodiments, a signature print 34 can be provided that has z-fold locations defined thereon that will induce z-folds 55 in a signature print 34 by supplying a printing system 10 with a receiver medium 8 that has pre-determined arrangement of z-fold locations at which the receiver medium 8 is adapted to z-fold. In still other embodiments, a receiver medium 8 or signature print 34 can have one or more materials applied before printing that can be activated to induce folding of the signature print in automatic z-fold system 46 through continuously applied processes such as the generalized application of an activating energy or an activation material. It will be appreciated that signature print 34 and receiver medium 8 can be modified in any conventional fashion that induces z-folding of a receiver medium 8 at predetermined locations and that automatic z-fold system 46 can be co-designed with receiver medium 8 in any of a variety of ways to urge induce or encourage or to simply allow folding according to the processing of the signature print 34. For example, in the embodiment of FIG. 12, signature print 34 can be weakened along the z-folds 55 such as by notching or perforating signature print 34 at the z-folds 55. When such a weakened signature print is permitted to stack, it may be useful to confine or urge signature print 34 to move in particular directions in order to cause z-folding of signature print 34 according to the arrangement of weakened areas.

It will further be appreciated that in other embodiments it can be useful to eliminate or reduce the need for, the extent of, or the character of, automatic trimming operations such as those performed by trimmer 84 of the embodiment of FIG. 5. As discussed above, such trimming performs two functions, creating separations in the signature print that are proximate to the z-folds 55 and to providing a common face 82 that has a determined profile notwithstanding the effects of creep. In certain embodiments, a signature print 34 can be adapted to provide features that can provide or enable alternatives to the use of trimming to perform either or both of these functions. This can help reduce the cost and complexity of a z-fold signature finishing system 40 and can increase throughput of z-fold signature finishing system 40.

In one example, a signature print 34 can be prepared with features that facilitate separation or by finishing a signature print 34 in ways that facilitate controlled separation of signature print 34 proximate to at least one of the z-folds 55. For example, signature print 34 can be weakened along a desired separation or signature print 34 to reduce an amount of separation force that must be applied to separate the signature print 34 at z-folds 55 such that a separation force can be applied to signature print 34 that would be insufficient to create a separation signature print 34 at an area of signature print 34 that has not been weakened, but that will cause separation in a weakened area. In some embodiments, the weakening caused during the bending required to make z-folds 55 can provide sufficient weakening, while in other embodiments signature print 34 can be perforated, notched, scored or otherwise modified to provide such weakening in other embodiments, signature print 34 can be weakened by the application of ink or water to a paper type medium.

Alternatively, a signature print 34 can be modified in other ways to help facilitate separation. For example, signature print 34 can be strengthened in areas adjacent to a desired separation such that a separation force applied proximate a z-fold 55 will cause separation in a desired location or such that application of a non-cutting separation force proximate at least one of the z-folds 55 will cause separation in the desired pattern. The signature print 34 can be strengthened by at least one technique of modifying the signature print, adding materials such as coatings, toners or resins to signature print 34, or applying energy to signature print 34.

It will be appreciated that any other method or apparatus for processing a signature print 34 to facilitate controlled separation of signature print 34 proximate to at least one of the z-folds 55 can be used. These methods can include application of a non-cutting separation force proximate the at least one of the z-folds 55 by at mechanically modifying signature print 34, adding solvents or other materials to signature print 34, or applying energy to the signature print 34 at the z-folds 55.

As shown in inset E, of FIG. 12, after saddle fold system 50 creates a saddle folded stack 78, the task of separating signature print 34 proximate to at least one of the z-fold locations can be performed by manually. In the embodiment of FIG. 12, this manual separation is made at weakened area of the z-folds 55 that are aligned along a common face 82. This can be done using a separation tool 96 such as a letter opener, ruler, or other flat-bladed instrument to provide the finished center-bound signature without cutting or trimming the z-folds 55 from the common face 82. It will be appreciated that this approach eliminates the complexity and expense of automatic cutting or trimming systems as well as the need to dispose of waste material that has been trimmed. Optionally, other methods can be used to help ensure that such manual processes will be performed in a manner that enables separation along a determined line along another shape or form that is preferred for artistic, creative or other reasons. Preferably the separation tool can be used to provide an amount of separating force that is sufficient to separate a weakened portion of signature print 34 but that is not sufficient to separate portions of the signature print 34 that have not been weakened.

Figure 13B:
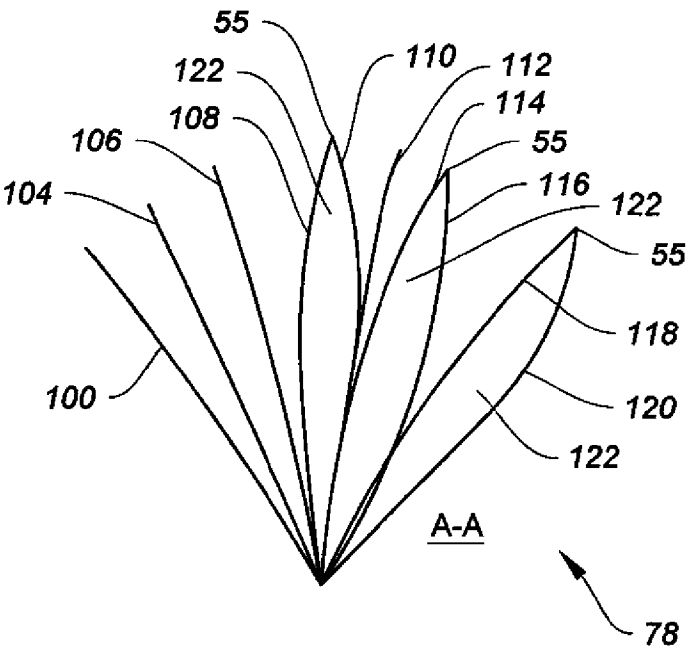
FIGS. 13A and 13B show joined page bowing and separation for forming a signature according to an embodiment of the present invention.
Figure 13A:
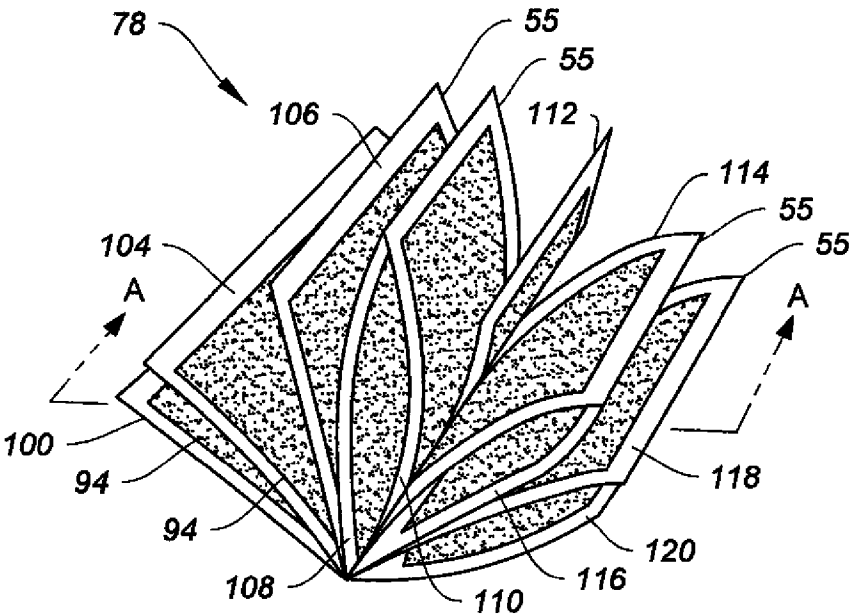

FIG. 13A shows a perspective view perspective of one embodiment of a saddle folded stack 78 while FIG. 13B shows cross-section view of saddle folded stack 78 along section A-A. In this embodiment, saddle folded stack 78 is intended for use in creating a 20-page signature 80. As is shown in FIGS. 13A-13B, several pages are joined by z-folds 55 and several pages are not joined by z-folds 55. A lead page 100 is along the outside of signature 80. Lead page 100 is formed at a leading edge of a signature print 34 and therefore is not connected at one end to another page by way of a z-fold 55. Similarly, a trailing page 112 is shown inside a saddle folded stack 78 and is a page formed at a trailing edge of signature print 34 that likewise is not connected at one end to another page by way of a z-fold 55. In contrast, pages 104 and 106 illustrate two pages that were bound together across a z-fold (not shown) that has been removed while pages 108 and 110 are shown still bound at a z-fold 55 as are pages 114 and 116 and pages 118 and 120. In the illustrated embodiment, saddle folded stack 78 will become the desired 20-page signature 80 upon separation of pages 108 and 110, 114 and 116 and 118 and 120. In certain embodiments, these pages can be left joined together for example, where a seven page signature is desired. However, it will be appreciated that a seven page signature 80 can be achieved in other ways using the methods that are described herein. As shown in FIGS. 13A and 13B, in certain embodiments, saddle folded stack 78 can provide a space 122 between pages that are joined by a z-fold 55, that are sized to enable insertion and use of separation tool 96. The paper grain of a receiver medium 8 on which the signature print 34 is formed can be oriented parallel to the fold direction to provide favorable folding or separation characteristics. A supplemental material, such as a varnish, plastic, toner, or other applied reinforcement coating, can be applied to facilitate handling, folding, or separation of the receiver at any of z-folds 55. For example, in one embodiment such coatings or materials can be applied proximate to a z-fold 55 that is to be separated in order to control or manage the shape of a separation.

Figure 14A:
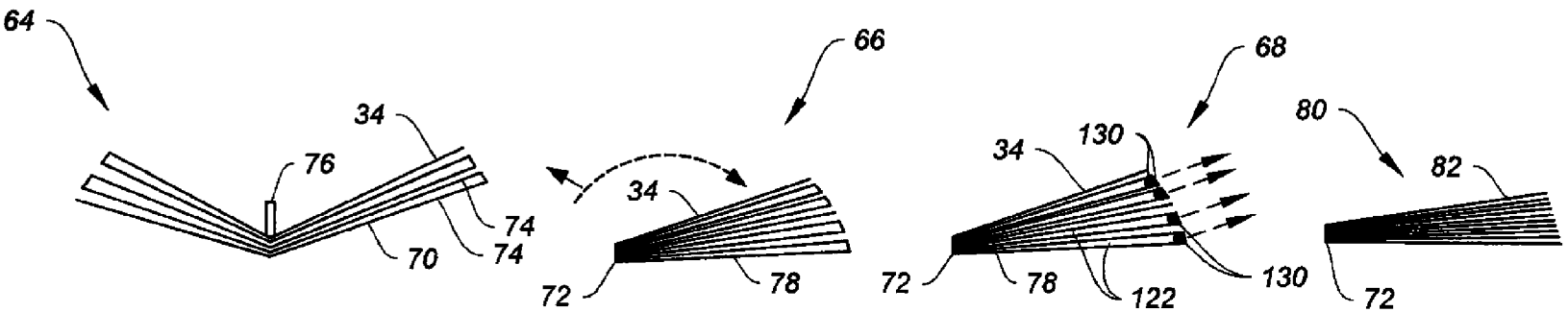
FIGS. 14A and 14B is a side view that shows alternate separation processes.

FIG. 14A illustrates another embodiment of a method for forming a signature 80. As is shown in FIG. 14A, a z-folded stack 70 of sheets 74 is bound (step 64) and then saddle folded (step 66) in a saddle fold system 50 to form a saddle folded stack 78. In this example, separation of signature print 34 proximate the z-folds 55 is performed by inserting a separation tool 130 in spaces 124 between un-separated pages and pulled away from the saddle fold location 72.

Figure 14B:
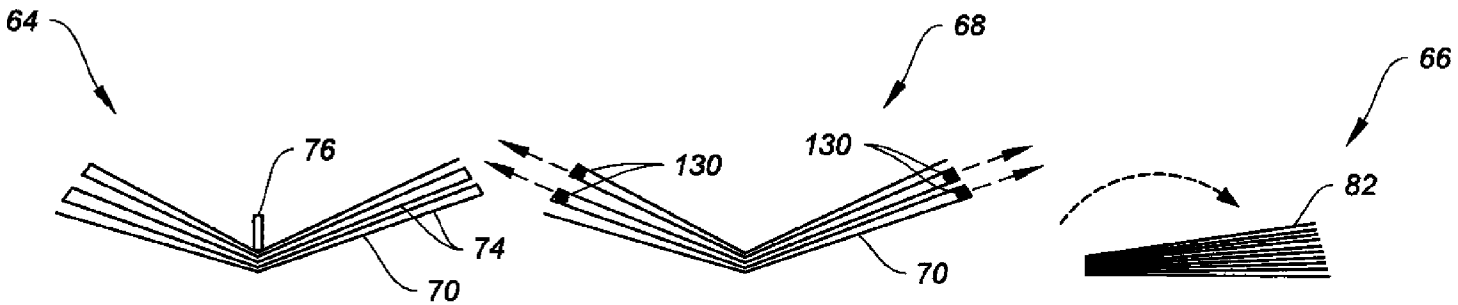

FIG. 14B shows an alternate embodiment of a method for forming a signature print. In this example, a binder 76 binds sheets 74 of a z-folded stack 70. Then, separation tool 130 separates signature print 34 proximate one or more of the z-folds 55 (step 68) prior to saddle folding (step 66).

Separation tool 130 can have one or more separation elements such as fingers or edges represented generally, by black dots in FIGS. 14A and 14B and subsequent figures, and indicate where signature print 34 can be separated to form separately turnable pages of signature 80. In the embodiment of FIGS. 14A and 14B, signature print 34 can have weakened areas such that separation tool 130 can achieve a separation of signature print 34 in a controlled manner using a blunt or non-cutting shape.

Figure 15B:
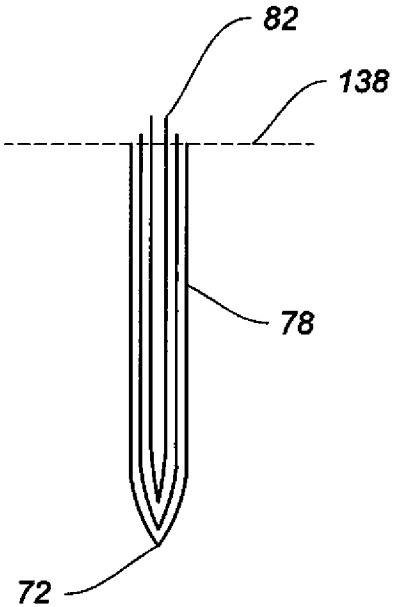
FIGS. 15A-15D are views showing page creep and compensation according to an embodiment of the present invention.
Figure 15A:
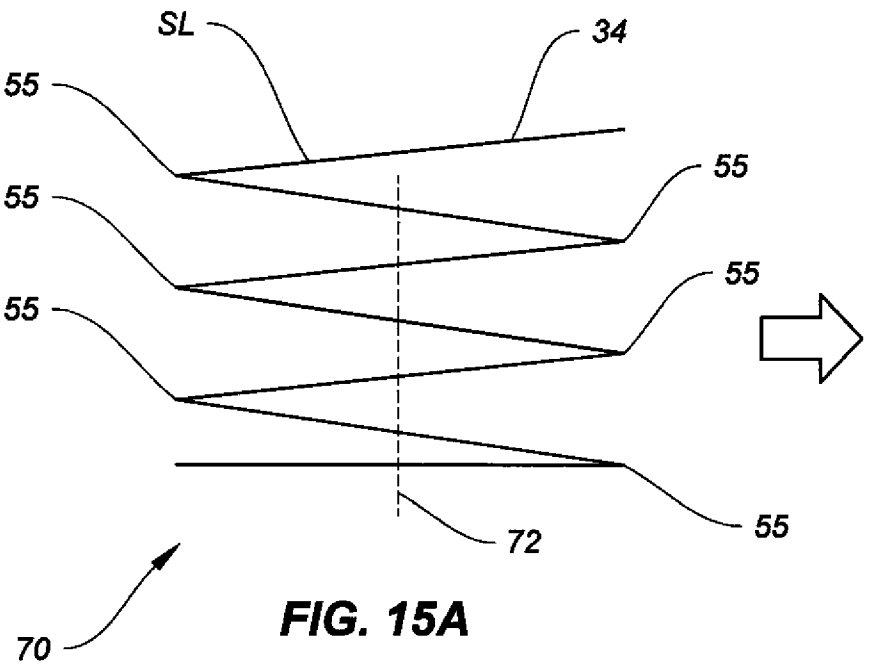

FIGS. 15A-15D (not to scale) illustrates how the arrangement of z-folds 55 along a length of the signature print can be used for creep compensation. FIG. 15A shows an example of a z-folded stack 70 formed having an arrangement of z-folds 55 along the length of a signature print 34 that form sheets 74 that have a generally of equal sheet length SL. When bound and folded proximate to saddle fold location 72, the resulting saddle folded stack have an uneven common face 82 in which pages toward the middle of the signature extend further from a saddle fold location 72 than those along the outside, as shown in exaggerated form in FIGS. 15A-15D. As is suggested by trim line 138 in FIG. 15B, and as is discussed above, one method to create a common face 82 having a desired profile such as a generally planar profile at the common edge is to trim along, for example, trim line 138. Alternatively, as discussed generally above, and as is shown in FIG. 11, a similar outcome can be achieved by providing bevel cuts lines 134 at z-folds 55 before they are folded to form the signature 80, with the bevel cuts lines 134 being defined to counter page creep.

Figure 15D:
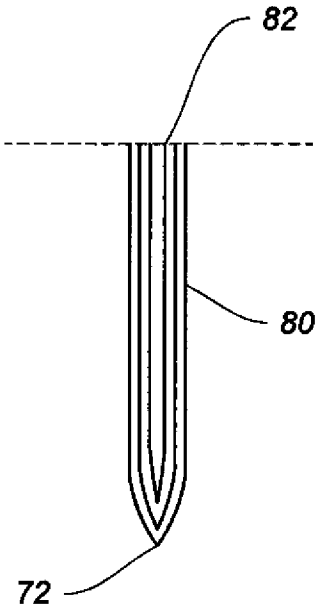
Figure 15C:
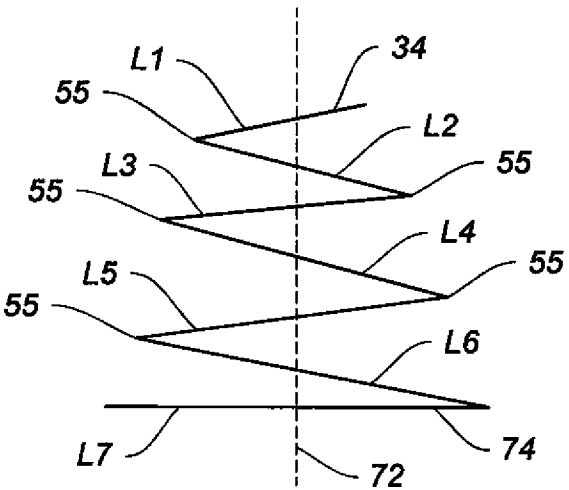

However, FIGS. 15C and 15D illustrate another approach made possible using various embodiments of the z-fold signature finishing system 40, the methods described herein or a signature print 34 that is predisposed to z-fold at predefined z-fold locations along a length of a signature print 34. Here, signature print 34 is induced to fold proximate to z-fold locations so that the length of the sheets 74 adjacent to z-folds 55 have a range of different lengths illustrated in FIGS. 15C and 15D as lengths L1 to L7, shown in highly exaggerated for in FIG. 15C. The lengths L1-L7 are varied so that when signature print 34 is saddle folded, saddle folded stack 78 is bound and saddle folded proximate to the saddle fold location 72. Because the relative locations of z-folds 55 control the extent to which z-folds 55 extend from saddle fold location 72, z-folds 55 are arranged to provide a determined profile at common face 82 such as the flat profile illustrated in FIG. 15D. This can be achieved using a signature print 34 that is predisposed to fold into a z-folded stack 70 when received for finishing or using a signature print 34 that is processed by an automatic z-fold system 46 so that a signature print 34 will fold into a z-folded stack 70.

It will be appreciated, that the extent of creep compensation provided will be a function of the number of sheets 74 of a signature print 34 in a z-folded stack 70 that are saddle folded, the thickness of the signature print 34, the presence or absence of toner between the folded sheets and such other factors as are generally described in greater detail above. In one example, the z-folded stack 70 can have sheets 74 of signature print 34 that have lengths vary between a longer length and a smaller length and in this example, z-folded stack 70 is saddle folded with a sheet having a shortest length at an innermost portion of a saddle fold location 72 and with sheets having longer lengths folded about sheets having shorter lengths at saddle fold location 72. In such an example, the difference in sheet lengths causes the z-folds 55 to be positioned along a common face 82 of signature 80 with a determined profile which can for example be a planar profile.

In certain embodiments, it can be useful to provide a signature print 34 having a sequence of z-folds 55 that are predisposed to cause z-folding at predetermined locations, printing a signature print 34 in a conventional fashion on a receiver medium 8 that is predisposed to z-fold along a predetermined arrangement of z-fold locations described herein.

Where this is done, the printing of signature print 34 on such a receiver medium 8 and ultimately the types of signature(s) that can be formed from such a signature print 34 will be limited according to the characteristics of the arrangement of z-fold locations on receiver medium 8. This approach may be advantageous for applications such as where it is desired to make a signature 80 having photographic prints, for example, wherein a booklet of a set number of prints is to be made available to a consumer.

Figure 16:
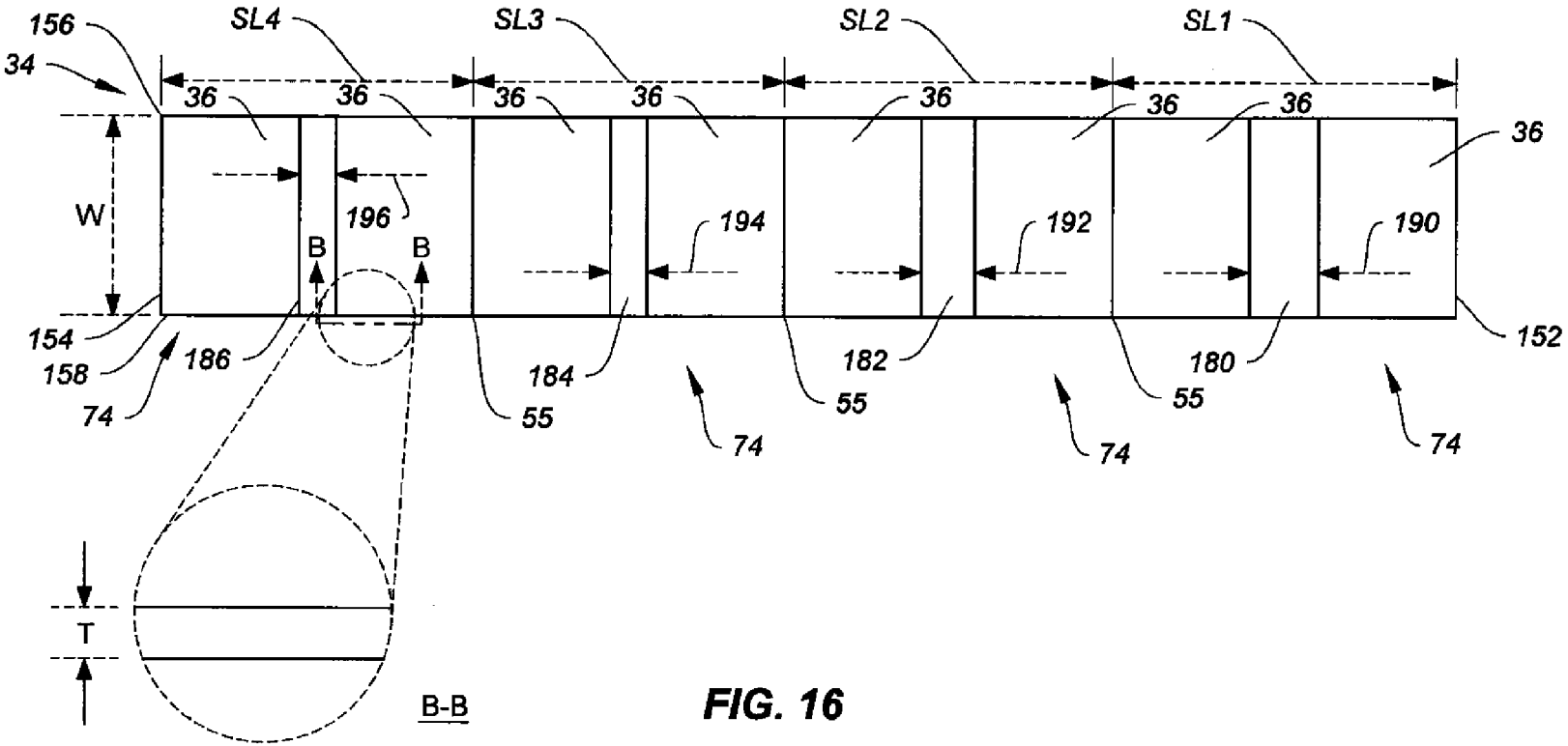
FIG. 16 is a plan view showing a signature print that provides different page lengths for a signature.

FIG. 16 shows one example of a signature print 34 that is fabricated for use as described with reference to FIGS. 15C and 15D. As is shown in FIG. 16 in this embodiment signature print 34 has a leading edge 152 and a trailing edge 154. As is shown in FIG. 16, z-folded stack 70 has a number of sheets 74 each having different lengths, shown here as first sheet length SL1, second sheet length SL2, third sheet length SL3, and fourth sheet length SL4. In the example of FIG. 16, first sheet length SL1 is greater than second sheet length SL2; second sheet length SL2 is greater than third sheet length SL3; and third sheet length SL3 is greater than fourth sheet length SL4. In this example, each sheet 74 has a common width W that is defined between lateral edges 156 and 158 and signature print 34 has a thickness T illustrated in insert B which shows a cross section of signature print 34.

Sheets 74 are separated by z-fold locations 160 formed in signature print 34. In one embodiment, z-folds 55 are induced by using receiver medium 8 that has been scored and perforated, although in other embodiments any method for modifying or otherwise causing folding of signature print 34 can be used. It should be noted that the sequentially decreasing sheet lengths from leading edge 152 to trailing edge 154 can be reversed, so that lengths increase for each successive sheet 74 from leading edge 152 to trailing edge 154, respectively.

As is also shown in FIG. 16, is an example arrangement of page areas 36 on sheets 74. According to this arrangement, two page areas of common size and orientation are within each sheet 74, and the two page areas are lengthwise separated by one of a set of boundaries 180, 182, 184, and 186. The boundaries 180, 182, 184 and 186 are defined so that there is a larger boundary length 190 for the sheet 74 having the first sheet length SL1, a smaller boundary length 192 for the sheet 74 having the second sheet length SL2, a still smaller boundary length 194 for the sheet 74 having the third sheet length SL3 and a smallest boundary length 196 for the sheet 74 having the fourth sheet length SL4. It will be appreciated that in making determinations as to how to compensate for creep effects or other effects, certain pages will be separated by a z-fold 55 while at least two pages will be defined by a leading edge and a trailing edge of signature print 34 and that no separation will be necessary at these pages. Accordingly page length calculations for the leading edge page and the trailing edge page will include any length necessary to compensate for any length of any page that unfolds bending that can occur from a separated z-fold 55.

Figure 17:
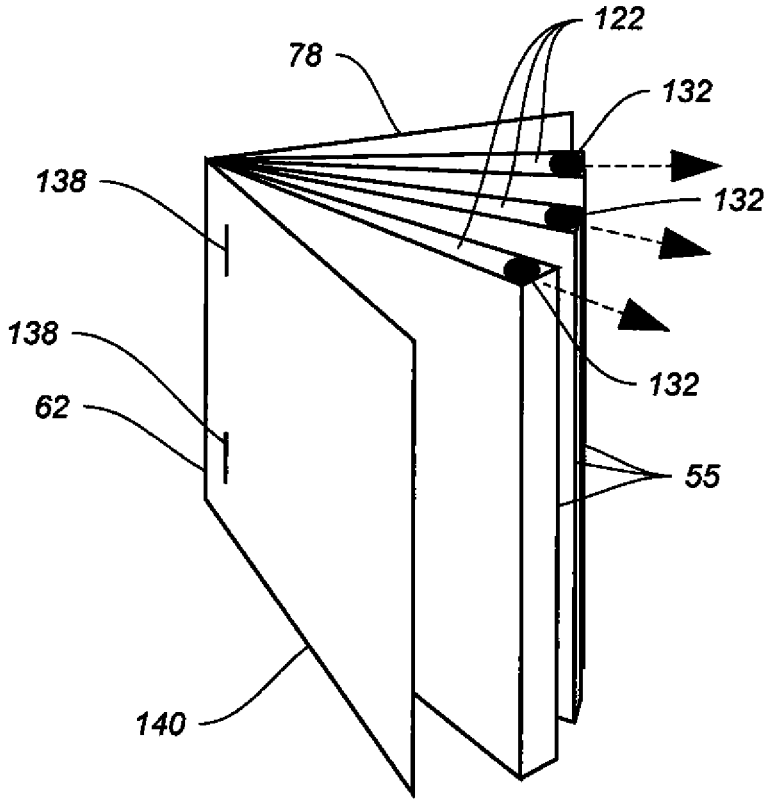
FIG. 17 is a perspective view that shows an alternate embodiment of a signature.

The perspective view of FIG. 17 shows an alternate embodiment in which binding (step 64) is performed after z-folding (step 62) and saddle folding (step 66) but before separation (step 68). As is shown here, one or more staples 138 or other forms of binding are used to bind saddle folded stack 78. Here z-folds 55 are shown being separated by moving a plurality of separators 132 in the directions illustrated to separate signature print 34 proximate to z-folds 55 to form separately turnable individual-pages. It will be appreciated that such a plurality of separators 132 can including rods, plates, wires, and the like that can be manually or automatically be inserted in spaces 122 and pulled outward by an actuator (not shown).

Z-fold signature finishing system 40 and the methods described herein provide a number of advantages for forming a signature. Particular advantages include the capability to form a signature having a variable number of pages. The method is flexible as to page size, allowing different page sizes to be printed and prepared from the same web medium in the same print run.

Figure 18B:
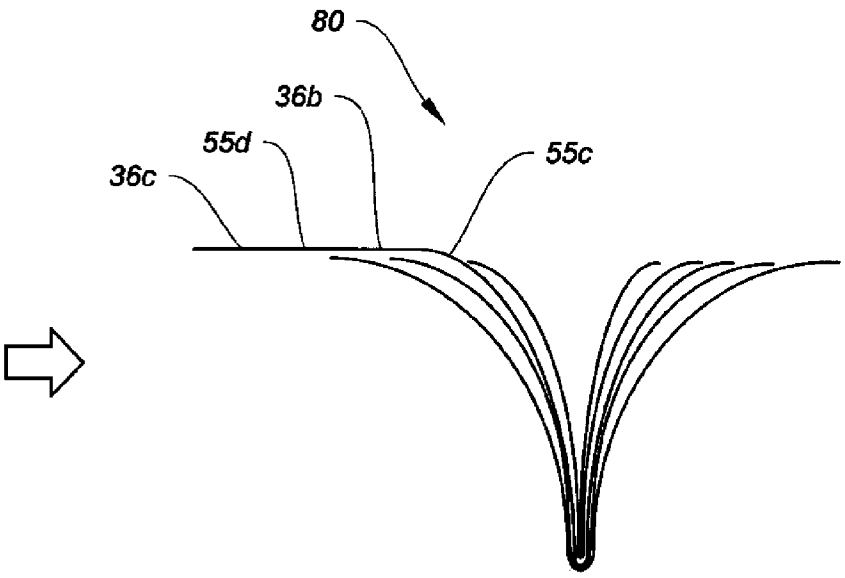
FIGS. 18A-18B illustrate an alternate embodiment providing a pullout page.
Figure 18A:
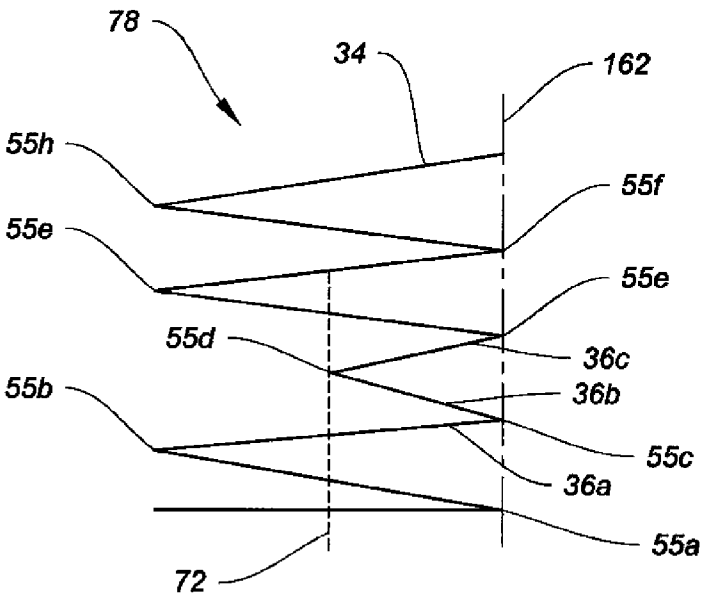

Further, page aspect ratios can be significantly different from page to page within a signature 80 formed as is described herein. For example as is illustrated in FIGS. 18A and 18B, it is possible, to define the locations of z-folds 55 in a z-folded stack 70 made using a signature print 34, to provide pages that can pop out or be pulled out to provide additional page length. For example, in the embodiment illustrated in FIG. 18A an arrangement of z-folds 55*a*-55*h* is formed, with z-folds 55*d* and 55*e* being arranged so that z-fold 55*c* will not be trimmed for example from a trim along a trim line 162 of a z-folded stack 70 and thus will remain attached to z-fold 55*c*, similarly z-fold 55*d* is shown being positioned so that it will not extend across saddle fold location 72 and thus will not be bound as will adjacent sheets of signature print 34. However, z-fold 55*e* is positioned so that it will be positioned to be cut from signature print 34.

As is shown in FIG. 18B, after, binding, saddle folding and trimming along trim line 162 (or otherwise separating signature print 34 proximate to z-folds 55*a*-55*c* and 55*e*-55*h*) a signature 80 is formed that provides a page that is that will include page area portions 36*a*, 36*b*, and 36*c* allowing selected pages within signature 80 to have an aspect ratio or length that is substantially different than adjacent pages without compromising the other advantages of the methods and z-fold signature finishing system 40. It will be appreciated that a signature print 34 can be provided for finishing having such an arrangement of folds.

It will be appreciated therefore that using the methods, signature prints and z-fold signature finishing systems 40 described herein, page aspect ratios are not constrained by sheet size considerations, as with conventional half-fold signature making processes. Additionally, special features such as pullout pages can be more easily prepared in a publication by varying sheet length at the lead or trailing edge of the signature print 34.

The creep problem, commonly seen due to conventional signature page-folding, as described earlier with reference to FIG. 2B, is greatly reduced, since z-folded stack 70 that is formed by the apparatus and methods of those described herein does not require cross folding in which one fold intersects another and requires only nested fold where one fold envelops another. It is instructive to observe that, using the z-fold arrangement of certain embodiments described herein, there are no folds formed across an existing fold. This is in contrast to the conventional imposition sequence for saddle-stitching, described previously with reference to FIGS. 2A and 2B, in which there are multiple folds upon folds. At the same time, the method is compatible with staples, thread, or any other suitable type of binding mechanism or agent, including adhesives and melted materials or elements for forming signature 80, as well as with methods for binding multiple signatures 80 together for book binding.

The binding method when using z-folding is inherently self-aligning, reducing or eliminating the need to trim top and bottom edges of the signature 80 in every case, which is required for conventional saddle-stitch folding. Methods of the present invention reduce the number of trimming cuts to as few as one; at common face 82, for a broad range of page sizes and aspect ratios.

Advantageously, finishing methods and apparatuses and mediums described herein can be used with any type of printing apparatus that forms an image onto a moving web 6, including offset print, electrophotographic, ink jet, or other printing technologies. Binding speed can be varied, so that z-folded output is formed continuously with the printing apparatus running at full speed or formed more slowly, as the printer stops and starts or changes speed.

The invention has been described in detail with particular reference to certain preferred embodiments thereof, but it will be understood that variations and modifications can be effected within the spirit and scope of the invention.

PARTS LIST

6 Web of receiver medium
8 Receiver medium
10 Digital printing system
12 Source roll
14 Dryer
16. Print engine
18 Take-up roll
20 First printing module
22 Positioning mechanism
24 Tension
26 Slack loop
28 Slack loop
29 Flip module
30 Second printing module
32 Controller
34 Signature print
34*a* Signature print
34*b* Signature print
34*c* Signature print
34*d* Signature print
35 First side of signature print
36 Page area
36*a* Page area
36*b* Page area
36*c* Page area
37 Second side of signature print
38 Communication system
40 z-fold signature finishing system
42 Supply
44 Receiver system
46 Z-folding system
47 Z-folder
48 Binding system
50 Saddle folder
51 Platen
52 Separator
53 Pivot
54 Controller
55 Z-fold
55*a* Z-fold
55*b* Z-fold
55*c* Z-fold
55*d* Z-fold
55*e* Z-fold
55*f* Z-fold
55*g* Z-fold
55*h* Z-fold
56 Communication circuit
57 Actuator
58 Cutting system
60 Receiver
62 Fold
64 Bind
66 Saddle fold
68 Separate
70 z-folded stack
71 Staggered z-fold stack
72 Saddle fold location
74 Sheet
74*a* Sheet
74*b* Sheet
74*c* Sheet
74*d* Sheet
76 Binder
78 Saddle folded stack
80 Signature
82 Face edge
84 Trimmer
86 Metadata tag
88 Indicia
92 Reader
94*a* Row
94*b* Row
94*c* Row
94*c* Row
96 Separation control
100 Page
104 Page
106 Page
108 Page
110 Page
112 Page
116 Page
118 Page
120 Page
128 Line
130 Separators
134 Trim line
138 Staple
152 Leading Edge
154 Trailing Edge
156 Lateral edge
158 Lateral edge
162 Trim line
180 Boundary
182 Boundary
184 Boundary
186 Boundary
190 Boundary length
192 Boundary length
194 Boundary length
196 Boundary length
200 Continuous web printing system
202 Paper
204 Web of paper
206 Roll
208 Core
210 Printed area
212*a* Printing subsystem
212*b* Printing subsystem
212*c* Printing subsystem
212*d* Printing subsystem
214 Printed paper
214*a* First side of printed paper
214*b* Second side of printed paper
216 Finishing system
218*a* First folder
218*b* Second folder
218*c* Third folder
220 Sheet
222 Sheet
225 Sheet
227 Sheet
229 Sheet
231 Sheet
232 First fold radius
233 Sheet
234 First fold length
235 Sheet

236 First face
238 Second face
240 Signature
239 Sheet
240 Signature
241 Sheet
242 Second fold radius
243 Sheet
244 Second fold length
247 Sheet
249 Sheet
L1 Sheet length
L2 Sheet length
L3 Sheet length
L4 Sheet length
L5 Sheet length
L6 Sheet length
L7 Sheet length
F1 First fold
F2 Second fold
F3 Third fold
P1 First page in signature
P2 Second page in signature
P3 Third page in signature
P4 Fourth page in signature
P5 Fifth page in signature
P6 Sixth page in signature
P7 Seventh page in signature
P8 Eight page in signature
P9 Ninth page in signature
P10 Tenth page in signature
P11 Eleventh page in signature
P12 Twelfth page in signature
P13 Thirteenth page in signature
P14 Fourteenth page in signature
P15 Fifteenth page in signature
P16 Sixteenth page in signature
SL Sheet length
SL1 First Sheet Length
SL2 Second Sheet Length
SL3 Third Sheet Length
SL4 Fourth sheet length
T Thickness of signature print

What is claimed is:

1. A z-fold signature finishing system comprising:

a receiver system to receive a signature print;

an automatic z-fold system configured to make a z-folded stack of sheets formed from separate portions of a length of a signature print with each sheet being joined to at least one other sheet in the z-folded stack by at least one of the z-folds;

a binding system having a binder that can bind the z-folded stack across a width of the stack proximate to a saddle fold location between the z-folds;

a saddle folder having at least two surfaces arranged so that the at least two surfaces and the z-folded stack can move relative to each other to cause the z-folded stack to fold proximate to the saddle fold location to dispose the z-folds along a common face of the saddle folded stack, and, a separation system separating the signature print proximate to at least one of the z-folds.

2. The z-fold signature finishing system of claim 1, further comprising a cutting system to cut the signature print from a continuous web of a printed receiver medium.

3. The z-fold signature finishing system of claim 1, wherein the cutting system can cut different widths of signature print from the printed web of receiver medium in response to signals provided by a controller.

4. The method of claim 3, wherein the receiving system receives the signature print from a printer.

5. The z-fold signature finishing system of claim 1, wherein the signature print is caused to fold across a width proximate to the z-fold locations by mechanically bending the signature print across the width.

6. The z-fold signature finishing system of claim 1, wherein the automatic z-fold system has a z-folder that mechanically induces the signature print to fold across the width proximate to the z-fold locations.

7. The z-fold signature finishing system of claim 1, wherein the automatic z-fold system has a z-folder that applies materials to the receiver medium that expand or contract to cause the signature print to fold across a width proximate to the z-fold locations.

8. The z-fold signature finishing system of claim 1, wherein the automatic z-fold system has a z-folder that applies energy proximate to the z-fold locations to modify the signature print so that the signature print is induced to fold proximate to the z-fold locations.

9. The z-fold signature finishing system of claim 1, wherein the automatic z-fold system has a z-folder that z-folder cooperates with a controller that determines the z-fold locations and that causes the z-folder to induce folding of the signature print into the z-folded stack with the z-folds proximate the determined z-fold locations.

10. The z-fold signature finishing system of claim 1, wherein the automatic z-fold system cooperates with a reader that reads information recorded on at least one of a metadata tag on a web with the signature print, the signature print, and a metadata tag on a web proximate to the signature print, and a controller that uses the information that is read by the reader to determine z-fold locations and that causes the automatic z-make the z-folded stack with z-folds proximate the determined z-fold locations.

11. The z-fold signature finishing system of claim 1, wherein the z-fold locations are spaced from the saddle fold location such that after the saddle folding the z-folds are positioned to form a generally planar profile at the common face.

12. The z-fold finishing system of claim 1, wherein the z-folded stack has sheets of lengths of the signature print that vary between a longer length and a shorter length, wherein two page areas of common size are within each length and wherein the two page areas are lengthwise separated by a boundary that has a larger boundary length for the sheet having the longer length and a smaller boundary length for the sheet having the shorter length.

13. The z-fold finishing system of claim 1, wherein the z-folded stack has sheets of the signature print that have lengths that vary between a longer length and a smaller length, and wherein the z-folded stack is saddle folded with a sheet having a shortest length at the saddle fold and with sheets having longer lengths folded about sheets having shorter lengths at the saddle fold, and wherein the difference in sheet lengths causes the z-folds to be positioned along the common face with a determined profile.

* * * * *